US008430717B2

(12) United States Patent
Duescher

(10) Patent No.: US 8,430,717 B2
(45) Date of Patent: Apr. 30, 2013

(54) DYNAMIC ACTION ABRASIVE LAPPING WORKHOLDER

(76) Inventor: Wayne O. Duescher, Roseville, MN (US)

( * ) Notice: Subject to any disclaimer, the term of this patent is extended or adjusted under 35 U.S.C. 154(b) by 403 days.

(21) Appl. No.: 12/902,665

(22) Filed: Oct. 12, 2010

(65) Prior Publication Data

US 2012/0088439 A1 Apr. 12, 2012

(51) Int. Cl.
*B24B 49/00* (2012.01)

(52) U.S. Cl.
USPC ..... 451/8; 451/41; 451/287; 451/288

(58) Field of Classification Search ..... 451/5, 8, 451/11, 41, 285–290
See application file for complete search history.

(56) References Cited

U.S. PATENT DOCUMENTS

| | | | |
|---|---|---|---|
| 4,593,495 | A | 6/1986 | Kawakami et al. |
| 4,918,870 | A | 4/1990 | Torbert et al. |
| 5,014,468 | A | 5/1991 | Ravipati et al. |
| 5,205,082 | A | 4/1993 | Shendon et al. |
| 5,314,513 | A | 5/1994 | Miller et al. |
| 5,364,655 | A | 11/1994 | Nakamura et al. |
| 5,569,062 | A | 10/1996 | Karlsrud |
| 5,643,067 | A | 7/1997 | Katsuoka et al. |
| 5,769,697 | A | 6/1998 | Nishio |
| 5,800,254 | A | 9/1998 | Motley et al. |
| 5,863,306 | A | 1/1999 | Wei et al. |
| 5,910,041 | A | 6/1999 | Duescher |
| 5,916,009 | A | 6/1999 | Izumi et al. |
| 5,964,651 | A | 10/1999 | Hose |
| 5,967,882 | A | 10/1999 | Duescher |
| 5,975,997 | A | 11/1999 | Minami |
| 5,989,104 | A | 11/1999 | Kim et al. |
| 5,993,298 | A | 11/1999 | Duescher |
| 6,048,254 | A | 4/2000 | Duescher |
| 6,089,959 | A | 7/2000 | Nagahashi |
| 6,102,777 | A | 8/2000 | Duescher et al. |
| 6,120,352 | A | 9/2000 | Duescher |
| 6,149,506 | A | 11/2000 | Duescher |
| 6,165,056 | A | 12/2000 | Hayashi et al. |
| 6,168,506 | B1 | 1/2001 | McJunken |
| 6,217,433 | B1 | 4/2001 | Herrman et al. |
| 6,371,838 | B1 | 4/2002 | Holzapfel |
| 6,398,906 | B1 | 6/2002 | Kobayashi et al. |
| 6,439,965 | B1 | 8/2002 | Ichino et al. |
| 6,506,105 | B1 | 1/2003 | Kajiwara et al. |
| 6,585,561 | B2 * | 7/2003 | Tokutake et al. ..... 451/5 |
| 6,607,157 | B1 | 8/2003 | Duescher |
| 6,752,700 | B2 | 6/2004 | Duescher |

(Continued)

*Primary Examiner* — Maurina Rachuba
(74) *Attorney, Agent, or Firm* — Mark A. Litman & Associates, P.A.

(57) ABSTRACT

A method and apparatus for quickly moving workpieces from having abrading contact with abrasive-surfaced rotatable platens using a dynamic-action workholder apparatus frame moving device that is activated by a sensor. Flat-surfaced workpieces are attached to flat-surfaced workholders to abrade one surface of the workpieces by abrasive coated platens. The force moving device can be a spring, an air cylinder, a screw-jack, an electric solenoid or a piezo-electric device. The sensor can be a vibration, shock, motion, force or sound sensor that can to sense abrading process events that could make it desirable to quickly activate moving of the workpieces away from the abrasive disk. The workpiece abrading event can be quickly interrupted by use of this device to avoid damage to workpieces, the abrasive disks or the platen or to quickly change an abrading process. After the workpieces are moved they can be returned to their original abrading position.

20 Claims, 2 Drawing Sheets

U.S. PATENT DOCUMENTS

| | | | | |
|---|---|---|---|---|
| 6,769,969 | B1 | 8/2004 | Duescher | |
| 6,786,810 | B2 | 9/2004 | Muilenburg et al. | |
| 6,893,332 | B2 | 5/2005 | Castor | |
| 6,896,584 | B2 | 5/2005 | Perlov et al. | |
| 6,899,603 | B2 | 5/2005 | Homma et al. | |
| 6,935,013 | B1 | 8/2005 | Markevitch et al. | |
| 7,001,251 | B2 | 2/2006 | Doan et al. | |
| 7,008,303 | B2 | 3/2006 | White et al. | |
| 7,014,535 | B2 | 3/2006 | Custer et al. | |
| 7,029,380 | B2 | 4/2006 | Horiguchi et al. | |
| 7,033,251 | B2 | 4/2006 | Elledge | |
| 7,044,838 | B2 | 5/2006 | Maloney et al. | |
| 7,125,313 | B2 | 10/2006 | Zelenski et al. | |
| 7,144,304 | B2 | 12/2006 | Moore | |
| 7,147,541 | B2 | 12/2006 | Nagayama et al. | |
| 7,166,016 | B1 | 1/2007 | Chen | |
| 7,235,002 | B1 * | 6/2007 | Pride | 451/43 |
| 7,250,368 | B2 | 7/2007 | Kida et al. | |
| 7,276,446 | B2 | 10/2007 | Robinson et al. | |
| 7,357,699 | B2 | 4/2008 | Togawa et al. | |
| 7,367,867 | B2 | 5/2008 | Boller | |
| 7,393,790 | B2 | 7/2008 | Britt et al. | |
| 7,422,634 | B2 | 9/2008 | Powell et al. | |
| 7,446,018 | B2 | 11/2008 | Brogan et al. | |
| 7,456,106 | B2 | 11/2008 | Koyata et al. | |
| 7,470,169 | B2 | 12/2008 | Taniguchi et al. | |
| 7,491,342 | B2 | 2/2009 | Kamiyama et al. | |
| 7,507,148 | B2 | 3/2009 | Kitahashi et al. | |
| 7,520,800 | B2 | 4/2009 | Duescher | |
| 7,527,722 | B2 | 5/2009 | Sharan | |
| 7,540,799 | B1 * | 6/2009 | Trojan | 451/8 |
| 7,582,221 | B2 | 9/2009 | Netsu et al. | |
| 7,614,939 | B2 | 11/2009 | Tolles et al. | |
| 7,632,434 | B2 | 12/2009 | Duescher | |
| 2005/0118939 | A1 | 6/2005 | Duescher | |
| 2007/0212983 | A1 * | 9/2007 | Nangoy et al. | 451/11 |
| 2008/0299875 | A1 | 12/2008 | Duescher | |
| 2010/0003904 | A1 | 1/2010 | Duescher | |

* cited by examiner

DYNAMIC ACTION ABRASIVE LAPPING WORKHOLDER

BACKGROUND OF THE ART

Field of the Invention

The present invention relates to flat lapping, polishing, finishing or smoothing of precision hard-material workpiece surfaces with diamond abrasive sheet disks that are operated at high surface speeds using rotatable abrading platens. In particular, the present invention relates to providing flexible disks that have annular bands of fixed-abrasive coated flat surfaced raised islands that can be successfully used to flat-lap hard workpieces at high abrading surface speeds in the required presence of coolant water without hydroplaning of the workpieces. These precision thickness abrasive disks are attached with vacuum to the upper flat horizontal surface of precision flatness rotary platens. In order to seal the platen vacuum port holes the flexible disks have a continuous mounting-side backing surface which allow the flexible disk to conform to the platen flat surface to effect the vacuum seal between the disk and the platen.

A workpiece work holding apparatus is described here that quickly springs-up in an event when an abrasive disk is torn during a high speed lapping operation. The dynamic action of the workholder lifts the workpiece away from abrading contact with the moving abrasive disk to reduce forces being applied to the workpieces by the torn abrasive disk that can become wedged between the moving platen surface and the workpieces.

Flat lapped workpieces require surface finishes that are both precisely flat and smoothly polished. The measured deviation of the localized workpiece surface height from a plane across the full width of a workpiece is used to establish a workpiece surface flatness. A typical flat lapped workpiece flatness is one lightband (11.1 millionths of an inch or 11.1 microinches or 0.28 micrometers) or much less and the polish is a mirror finish. This degree of accuracy that has to be provided across the full flat surface of a workpiece at high abrading speeds is beyond the capability of conventional abrasive articles. The described flatness variations of a flat lapped workpiece are typically so small that even an exceedingly thin film of coolant water can be wedged into the small workpiece surface angled defects by high speed abrasives and cause substantial hydroplaning.

A typical flat lapped polished minor surface finish ranges from 0 to 0.5 microinches (0 to 0.013 micrometers). The smoothness or polish of a workpiece surface is established by measuring the deviation movement of stylus probe across a short localized segment of the workpiece surface. Here, a profilometer device can be used to measure the depth of workpiece surface scratches to numerically establish the smoothness of the polished surface finish. As the abrading scratches that are produced in a workpiece by an abrasive particle is approximately equal to the size of the particle it is necessary to use diamond abrasive particles that are much smaller in size than 0.1 micrometer (0.0000039 inches) to produce these mirror finishes. Flat lapping requires the use of abrasive particles that are much smaller in size than are used in conventional abrading. However, it is common practice to encapsulate these very small diamond abrasive particles in abrasive agglomerate beads that have a typical bead diameter of 45 micrometers (0.0018 inches), a bead size that is very practical to coat on an abrasive article.

Flat lapping is used to develop the most accurate, precisely-flat and smoothly polished workpiece surfaces of any of the many techniques of abrading flat surfaces. Many of the workpieces that are flat lapped have flat surfaced cylindrical shapes but many other workpieces have square or rectangular surface shapes. Most flat lapped workpieces are high value devices. Some examples of these workpieces are semiconductor devices, optical devices and ceramic seals. Flat lapping is performed where the flat surface of a workpiece is in full-face abrading contact with a flat surface of abrasive media that is supported by a rigid and precision flat surfaced platen. In a flat lapping process only the highest localized areas of the workpiece surface are abraded away to develop a flat surface. As the abrasive is in planar contact with the workpiece, the abrading process starts with only a few workpiece high-spot areas in contact with the abrasive but ends with the full flat surface in contact with the abrasive.

It is critical that the workpiece surface conforms to the flat surface of the abrasive that is supported by the rigid flat platen to develop the required surface flatness and smooth polish over the full surface of the workpiece. In almost all cases, the workpiece is rotated while it is in contact with the abrasive. A workpiece surface can be rigidly held against an abrading surface by mounting the workpiece on a rotating shaft having an axis that is perpendicular to the abrasive surface. Also, the workpiece surface can be allowed to spherically pivot while it is in rotating contact with the abrasive. If a rotating workpiece holder is rigid, the workpiece surface must be held perfectly perpendicular to the abrasive surface during the abrading process. This presents a lapping equipment design challenge that is difficult to accomplish because of the alignment accuracies that are required for flat lapping and also, the rigidity required for the workpiece holder. Here, the structural deflections of both the workpiece and the holder that are caused by the dynamic abrading contact forces can easily result in non-precision-flat workpiece surfaces. Because of these difficulties, most lapped workpieces are allowed to "float" where they self-align their flat surfaces to the flat surface of the abrasive covered platen during an abrading process. Two of many methods used to allow the workpiece to conform flat to the abrasive include: 1) simply laying the workpiece face down on the abrasive; and 2) mounting the workpiece on a spherical-action holder that is lowered onto the abrasive. However, simply laying a workpiece face down on the flat abrasive surface of a high speed rotary abrasive lapper is not practical because dynamic impact forces caused by small variations in the fast moving abrasive surface will tend to throw the workpiece off the abrasive surface. Also, the use of spherical action workpiece holders for high speed lapping requires a spherical action. Preferably the spherical holder has a special off-set center-of-rotation where this rotation center is at or just slightly above the abrasive surface to prevent abrading contact forces from tipping the workpiece during the abrading action.

Very small workpiece abrading contact pressures are used with high speed flat lapping as compared to other types of abrading flat workpiece surfaces. These small abrading contact forces or small workpiece clamping forces are required to avoid even the smallest structural distortion of the workpieces by these forces during the abrading process. For instance, the workpiece surface can be abraded precisely flat during the time that the workpiece is structurally distorted by a workpiece holder clamping forces or by abrading forces. After the forces are removed, the already abraded workpiece structure will spring-back to a new geometric shape that then has an undesirable non-flat shape. Here, the structural relaxation of the workpiece distorts the original abraded-flat workpiece surface. Because the required accuracy of a typical flat lapped surface is so great, even a very minor structural distortion of a workpiece will cause the surface flatness to become unacceptable. This is seldom the case for workpieces that are abraded by conventional abrading methods, particularly those that use traditional aluminum oxide abrasive disk articles.

During flat lapping, the sizes of the abrasive particles must be sequentially changed from coarse to fine to obtain flat workpieces that are also smooth. Coarse larger sized particles are used to develop a flat surface. Fine smaller sized particles are used to develop smooth surfaces. Typically, the flat lapping is accomplished with the use of multiple individual abrasive disks that have progressively finer abrasive particles. The selection of the abrasive particle sizes for each abrading step is optimized to assure that the subsequent smaller sized abrasive cuts the workpiece material effectively to provide uniform material removal and a smoother finish. During a high-speed flat lapping process, it is preferred that the size of the abrasive particles is progressively reduced in three steps or even less. For example: 6 micrometer particles are used in the first step; 3 micrometer particles are used in the second step; and 1 micrometers are used in the third step.

Rotary platens are used almost exclusively for flat lapping because a rotary platen can provide a system that has a constant abrading speed and smooth lapping machine action throughout an abrading process. However, rotary platens have a disadvantage in the localized abrading surface speed changes with the radial position on the platen. The platen outer radius has high surface speeds and the platen inner radius has low surface speeds. Because the localized abrading cut rate is proportional to the localized abrading surface speed, equalized material removal occurs across the area of the workpiece when the abrading speed is also uniform across the area. As the abrasive located at the inner radius of a disk moves relatively slow, little abrasive surface wear is experienced at these inner locations, which produces an uneven abrasive surface in a radial direction. Uneven wear of an abrasive surface prevents providing a precision flat abrading surface to a workpiece which produces uneven wear on the workpiece. The use of annular bands of abrasive along with the rotation of workpieces in the same direction as the platen rotation minimizes the problem of mutual abrasive and workpiece wear when using a rotary platen, which assures that the full workpiece surface is evenly abraded.

Other abrading equipment such as reciprocal motion platens can be used for flat lapping but they are very limited in performance. Reciprocal platens change motion directions periodically (at the end of each cycle) which is dynamically disruptive and results in non-smooth lapping machine actions. It is important that the lapping machine abrading motions are continuously smooth.

Because the localized abrading cut rate is also proportional to the localized contact pressure, equalized material removal occurs across the area of the workpiece when the contact pressure is also uniform across the area. Great care is taken to provide an even abrading contact pressure across the full surface of a workpiece during an abrading process.

In conventional abrasive slurry lapping, the abrasive media is a paste or liquid slurry mixture of loose abrasive particles that is coated on the surface of a rotary platen. Platens are rotated while the workpieces are typically held at a fixed location in flat surface contact with the abrasive. Individual abrasive particles are trapped in the interface gap between the flat workpiece surface and the moving flat platen. The interface gap has a large thickness relative to the size of the abrasive particles. Here, individual abrasive particles are stacked up within the slurry layer and these particles tend to circulate within slurry layer thickness during abrading action. Slurry lapping is not done with a monolayer of abrasive particles. New individual abrasive particles are continuously presented from the depths of the slurry layer to the workpiece surface by the slurry shearing action provided by the relative motion between the workpiece and platen surfaces. Individual abrasive particles can become dull or the slurry may become contaminated with abraded workpiece material debris in which cases the abrasive slurry is replaced.

This shearing action also results in the high spot areas of the flat surface of the workpiece being abraded away by those abrasive particles in the gap that are in contact with the workpiece and move relative to the workpiece. Because abrading forces are concentrated in the areas of the high spots, more workpiece surface material is removed at high spot locations than in the adjacent low spot areas. Abrading away the high spots flattens the workpiece.

BACKGROUND OF THE INVENTION

This invention references commonly assigned U.S. Pat. Nos. 5,910,041; 5,967,882; 5,993,298; 6,048,254; 6,102,777; 6,120,352; 6,149,506; 6,607,157; 6,752,700; 6,769,969; 7,632,434 and 7,520,800 and commonly assigned U.S. patent application published numbers 20100003904, 20080299875 and 20050118939 and all contents of which are incorporated herein by reference.

U.S. Pat. No. 7,614,939 (Tolles et al) describes a CMP polishing machine that uses flexible pads where a conditioner device is used to maintain the abrading characteristic of the pad. Multiple CMP pad stations are used where each station has different sized abrasive particles. U.S. Pat. No. 4,593,495 (Kawakami et al) describes an abrading apparatus that uses planetary workholders. U.S. Pat. No. 4,918,870 (Torbert et al) describes a CMP wafer polishing apparatus where wafers are attached to wafer carriers using vacuum, wax and surface tension using wafer. U.S. Pat. No. 5,205,082 (Shendon et al) describes a CMP wafer polishing apparatus that uses a floating retainer ring. U.S. Pat. No. 6,506,105 (Kajiwara et al) describes a CMP wafer polishing apparatus that uses a CMP with a separate retaining ring and wafer pressure control to minimize over-polishing of wafer peripheral edges. U.S. Pat. No. 6,371,838 (Holzapfel) describes a CMP wafer polishing apparatus that has multiple wafer heads and pad conditioners where the wafers contact a pad attached to a rotating platen. U.S. Pat. No. 6,398,906 (Kobayashi et al) describes a wafer transfer and wafer polishing apparatus. U.S. Pat. No. 7,357,699 (Togawa et al) describes a wafer holding and polishing apparatus and where excessive rounding and polishing of the peripheral edge of wafers occurs. U.S. Pat. No. 7,276,446 (Robinson et al) describes a web-type fixed-abrasive CMP wafer polishing apparatus.

U.S. Pat. No. 6,786,810 (Muilenberg et al) describes a web-type fixed-abrasive CMP article. U.S. Pat. No. 5,014,468 (Ravipati et al) and U.S. Pat. No. 5,863,306 (Wei et al) describe a web-type fixed-abrasive article having shallow-islands of abrasive coated on a web backing using a rotogravure roll to deposit the abrasive islands on the web backing. U.S. Pat. No. 5,314,513 (Milleret al) describes the use of ceria for abrading.

Various abrading machines and abrading processes are described in U.S. Pat. No. 5,364,655 (Nakamura et al). U.S. Pat. No. 5,569,062 (Karlsrud), U.S. Pat. No. 5,643,067 (Katsuoka et al), U.S. Pat. No. 5,769,697 (Nishio), U.S. Pat. No. 5,800,254 (Motley et al), U.S. Pat. No. 5,916,009 (Izumi et al), U.S. Pat. No. 5,964,651 (hose), U.S. Pat. No. 5,975,997 (Minami), U.S. Pat. No. 5,989,104 (Kim et al), U.S. Pat. No. 6,089,959 (Nagahashi), U.S. Pat. No. 6,165,056 (Hayashi et al), U.S. Pat. No. 6,168,506 (McJunken), U.S. Pat. No. 6,217,433 (Herrman et al), U.S. Pat. No. 6,439,965 (Ichino), U.S. Pat. No. 6,893,332 (Castor), U.S. Pat. No. 6,896,584 (Perlov et al), U.S. Pat. No. 6,899,603 (Homma et al), U.S. Pat. No. 6,935,013 (Markevitch et al), U.S. Pat. No. 7,001,251 (Doan et al), U.S. Pat. No. 7,008,303 (White et al), U.S. Pat. No. 7,014,535 (Custer et al), U.S. Pat. No. 7,029,380 (Horiguchi et al), U.S. Pat. No. 7,033,251 (Elledge), U.S. Pat. No. 7,044,838 (Maloney et al), U.S. Pat. No. 7,125,313 (Zelenski et al), U.S. Pat. No. 7,144,304 (Moore), U.S. Pat. No. 7,147,541 (Nagayama et al), U.S. Pat. No. 7,166,016 (Chen), U.S. Pat. No. 7,250,368 (Kida et al), U.S. Pat. No. 7,367,867 (Boller), U.S. Pat. No. 7,393,790 (Britt et al), U.S. Pat. No. 7,422,634 (Powell et al), U.S. Pat. No. 7,446,018 (Brogan et al), U.S. Pat. No. 7,456,106 (Koyata et al), U.S. Pat. No. 7,470,169 (Taniguchi et al), U.S. Pat. No. 7,491,342 (Kamiyama et al), U.S. Pat. No. 7,507,148 (Kitahashi et al), U.S. Pat. No. 7,527,722 (Sharan) and U.S. Pat. No. 7,582,221 (Netsu et al).

I. High Speed Lapping History

The high speed lapping system of the present invention was initially developed for use with conventional diamond abrasive bead coated fixed-abrasive disk articles. These disks have a continuous coating of a monolayer of abrasive beads across the full disk surface. The beads contain small diamond abrasive particles that are enclosed in a soft erodible ceramic matrix. It had been found earlier that these abrasive disks could be used on lapidary polishing machines in the presence of water lubricant at high abrading speeds to polish geological rock samples at very high production cut rates as compared to the slow moving polishing machines or abrasive slurry systems. However, even though the lapping machines used in this early application could provide smooth surfaces on these lapidary workpieces they failed to produce the precisely flat surfaces that are required for use in the flat lapping of precision-surfaced commercial parts or semiconductor workpieces. It was then initially assumed that the simple provision of a more precise, heavy, sturdy and stable rotary-table lapping machine (than the polishing machine used earlier for the lapidary abrading) would allow the simultaneous creation of smoothly polished and precisely flat workpiece surfaces with these same continuous coated fixed abrasive disks. After building different very precise and robust lapping machines that provided very accurate control of abrading pressures along with very flat platens that maintained a very precise flatness abrading surface at high rotational speeds, it was found that this was not the case. These water cooled continuous-surface coated abrasive disks could not produce precisely flat workpiece surfaces when operated at high speeds. However, these same continuous coated abrasive disks, as used on the high speed lapping machines, did very quickly provide smoothly polished (but non-flat) hardened material workpieces. The present abrasive system high speed lapping machine technology is also described in Duescher U.S. Pat. Nos. 5,910,041, 5,967,882, 5,993,298, 6,048,254, 6,102,777, 6,120,352, and 6,149,506.

II. Raised Island Disks

This lapping system can be operated at such high speeds due to the use of precision-thickness abrasive coated raised island disks. Moving abrasive disks are surface cooled with water to prevent overheating of both the workpiece and the abrasive particles. Raised islands prevent hydroplaning of the stationary workpieces that are in flat conformal contact with water wetted abrasive that moves at very high speeds. Abrading speeds are often in excess of 100 mph. Hydroplaning occurs with conventional non-island continuous-coated lapping film disks where a high pressure water film is developed in the gap between the flat workpiece and the flat abrasive surfaces.

During hydroplaning, the workpiece is pushed up away from the abrasive by the high pressure water and also, the workpiece is tilted. These cause undesirable non-flat workpiece surfaces. The non-flat workpieces are typically polished smooth because of the small size of the abrasive particles. However, flat-lapped workpieces require surfaces that are both precision-flat and smoothly polished.

The islands have an analogy in the tread lugs on auto tires which are used on rain slicked roads. Tires with lugs grip the road at high speeds while bald tires hydroplane. Conventional continuous-coated lapping film disks are analogous to the bald tires.

Raised islands also reduce "stiction" forces that tend to bond a flat surfaced workpiece to a water wetted flat-surfaced abrasive surface. High stiction forces require that large forces are applied to a workpiece when the contacting abrasive moves at great speeds relative to the stationary workpiece. These stiction forces tend to tilt the workpiece, resulting in non-flat workpiece surfaces. A direct analogy is the large attachment forces that exist between two water-wetted flat plates that are in conformal contact with each other. It is difficult to slide one plate relative to the other. Also, it is difficult to "pry" one plate away from the other. Raised island have recessed channel passageways between the island structures. The continuous film of coolant water that is attached to the workpiece is broken up by these island passageways. Breaking up the continuous water film substantially reduces the stiction.

III. Precision Thickness Disks

Another reason that this lapping system can be operated at such high speeds is due to the use of precision-thickness abrasive coated raised island disks. These disks have an array of raised islands arranged in an annular band on a disk backing. The top flat surfaces of the islands are coated with a very thin coating of abrasive. The abrasive coating consists of a monolayer of 0.002 inch beads that typically contain very small 3 micron (0.0001 inch) or sub-micron diamond abrasive particles. Raised island abrasive disks are attached with vacuum to ultra-flat platens that rotate at very high abrading surface speeds, often in excess of 100 mph.

The abrasive disks have to be of a uniform thickness over the full abrading surface of the disk for three primary reasons. The first reason is to present all of the disk abrasive in flat abrading contact with the flat workpiece surface. This is necessary to provide uniform abrading action over the full surface of the workpiece. If only localized "high spots" abrasive surfaces contact a workpiece, undesirable tracks or gouges will be abraded into the workpiece surface. The second reason is to allow all of the expensive diamond abrasive particles contained in the beads to be fully utilized. Again if only localized "high spots" abrasive surfaces contact a workpiece, those abrasive particles located in "low spots" will not contact the workpiece surface. Those abrasive beads that do not have abrading contact with a workpiece will not be utilized. Because the typical flatness of a lapped workpiece are measured in millionths of an inch, the allowable thickness variation of an raised island abrasive disk to provide uniform abrasive contact must also have extra-ordinary accuracy.

The third reason is to prevent fast moving uneven "high spot" abrasive surfaces from providing vibration excitation of the workpiece that "bump" the workpiece up and away from contact with the flat abrasive surface. Because the abrasive platens rotate at such high speeds and the workpieces are lightweight, these moving bumps tend to repetitively drive the workpiece up after which it falls down again with only occasional contact with the moving abrasive. The result is uneven wear of the workpiece surface.

IV. Abrasive Disks and Platen Abrasive Coatings

Abrasive coatings on the platens surfaces that can be provided can be selected from the group consisting of flexible abrasive disks, flexible raised-island abrasive disks, flexible abrasive disks with resilient backing layers, flexible abrasive disks with resilient backing layers having a vacuum-seal polymer backing layer, flexible abrasive disks having attached solid abrasive pellets, flexible chemical mechanical planarization (CMP) resilient disk pads that are suitable for use with liquid abrasive slurries, flexible chemical mechanical planarization resilient disk pads having nap covers, flexible shallow-island chemical mechanical planarization abrasive disks, flexible shallow-island abrasive disks with resilient backing layers having a vacuum-seal polymer backing layer, flexible flat-surfaced metal or polymer disks, and liquid abrasive-slurry coatings.

V. Tearing of Thin Abrasive Disk Backings

When abrasive disk backings are too thin for use for high speed flat lapping, these too-thin disk backings can be torn or ripped if they are subjected to sharp-edged instruments being plunged into the backing surface when the abrasive disk is rotated at high speeds on fast moving rotary platens. These abrasive disks then loose the vacuum disk-attachment forces that bond the disks to the platen flat disk-mounting surface because the vacuum attachment forces are interrupted when the disks are torn. The thin and very flexible torn disks can become creased and crumpled when they are torn and become wedged between the workpiece flat surfaces and the workpiece holder mechanism. The fast moving platens have high mass inertias that prevent fast deceleration of the platens immediately after the occurrence of an abrasive disk backing tear event. The torn abrasive disks tend to drag against the surface of the moving abrading platen which can result in wear of the precision-flat platen surface.

Lapping sheet abrasive articles that use these thin polymer backings and thin abrasive binder coatings of abrasive materials are used successively at low abrading speeds for abrasive flat lapping procedures without substantial tearing problems. The slow abrading speeds allow the abrading machine components to be quickly decelerated to prevent abrading wear of precision-flat platen surfaces.

When a flexible abrasive disk sheet is attached to a flat platen with the use of vacuum, a hold-down force pressure of nearly one atmosphere (!4.7 lbs/sq. inch) is applied to all of the flat surface of the abrasive article. There is no distortion of the abrasive disk out-of-plane from the original-condition disk surface as the platen is flat and the flexible abrasive disk easily conforms to the flat platen with no localized stress-risers in the disk backing material. The vacuum system provides a very large clamping force to the abrasive disk because the atmospheric pressure acts against the large surface area of the disk. A 12 inch diameter circular disk having a total surface area of 422 square inches that is acted upon by 14 lbs per square inches of vacuum induced pressure will have a total disk clamping force of 6,333 lbs that is evenly applied over the flat surface of the disk. This large vacuum induced clamping force does not distort the abrasive disk as the force is applied over the whole disk area and the force acts through the thickness of the abrasive disk, which is very stiff in this direction. A large clamping force offers an important advantage in that it does tend to prevent the possibility of lifting up a portion of an abrasive disk from a platen surface during abrading action and to prevent tearing of a disk that is constructed from a thin backing material.

The vacuum disk attachment system allows an abrasive disk to be used repetitively. A disk can be used to abrade a workpiece after which it is quickly removed from the platen by releasing the vacuum. Then another disk having smaller abrasive particles is quickly attached to the platen and abrading of the same workpiece continued. The platen surface can be coated with a mist of water, which aids in sealing the disk-to-platen surface to prevent vacuum-air leakage and to assure the presence of the vacuum induced disk-clamping force. The process of abrading a workpiece with a succession of finer abrasive grits is easily accomplished with a platen vacuum disk mounting system. When a new workpiece is abraded, the same original abrasive disks having different grit sizes can be used again in the same succession to complete the abrading of the new workpiece. A workpiece is first contacted by coarse abrasive grits and is finished with very fine abrasive particles that are often less than 1 micrometer in size that are contained in spherical abrasive beads having a bead diameter of 0.002 inches (45 micrometers).

An abrasive disk that is held to the surface of a platen has a significant coefficient of friction between the disk surface and the platen surface and the disk mounting surface friction resists movement of the abrasive disk sheet relative to the platen surface. The coefficient of friction between the abrasive disk and the platen can be enhanced by surface coatings, etching or otherwise surface conditioning of either the surfaces of the abrasive disk backing or of the platen surface, or both.

Raised-island abrasive disks used for high speed flat lapping have extremely flat abrasive surfaces and abrasive disk thicknesses that are uniform across the full annular abrading surface of the abrasive disk. The typical allowable abrasive disk thickness is less than 0.0001 inches (2.5 micrometers). For high speed flat lapping, the required out-of-plane variations in the platen flatness at all platen rotational speeds typically are to be less than 0.0001 inches (2.5 micrometers) for all sizes of abrasive disks even for those disks having 72 inch (183 cm) or greater diameters.

Use of abrasive disks that have thick and tough abrasive backings prevents the problem of tearing of these disk backings when they are contacted with sharp instruments. Also, these thick backings do not tend to crumple and loose their vacuum hold-down seal with the result that the abrasive disks do not become detached from the rotating platen surface during a disk-cutting event. Providing thick-backing raised-island abrasive disks with a precision-thickness is simple because the disks are fabricated by attaching raised island structures to the disk backing and then precision-thickness grinding the exposed top surfaces of the island structures relative to the bottom mounting surface of the backing. These precision-thick raised island structures are then coated with a thin layer of abrasive particles to form the abrasive coated raised island abrasive disks.

SUMMARY OF THE INVENTION

Friction-activated or sensor-activated dynamic action workholder systems can be used to quickly raise workpieces up from flat surfaced abrading contact with the abrasive surface of a rotatable platen when the platen is rotated. Platen typically have flexible abrasive disks attached to the platen flat annular abrading surfaces by vacuum. In the event where an abrasive disk is torn or damaged, portions of the abrasive disk can be lifted away from the flat surface of the platen and the vacuum seal between the abrasive disk and the platen is broken and the disk becomes detached from the platen. This detached flexible disk can become wedged in a stationary position between the high-inertia rotating platen and the stationary workpiece holder device. When the disk becomes wedged, a large friction force is developed and applied on the workholder device by the rotating platen. This friction force tends to suddenly lift the workholder and can damage it. Also, the station abrasive disk would tend to rub on the rotating platen and can damage the precision-flat surface of the platen that is used to mount abrasive disks on.

This friction-activated or sensor-activated dynamic action workholder system can quickly be raised upward away from the surface of the platen where the workpieces are lifted to avoid abrading contact with the abrasive disk or to avoid contact with the abrading platen. In addition vibration, shock, motion, force or sound sensors can be attached to the abrading machine to sense abrading process events that could make it desirable to activate lifting of the workpieces away from the surface of the platen. Further, the same dynamic action workholder system can activated by abrading machine process controllers to activate lifting of the workpieces away from the surface of the platen as a part of the abrading process or to quickly interrupt an abrading procedure on individual or all of the workpieces being abraded by an abrading machine.

Also, this friction-activated or sensor-activated dynamic action workholder system can be used for a wide variety of platen-type abrading machines comprising: abrasive disk machines, liquid abrasive slurry machines, chemical mechanical planarization (CMP) machines; resilient abrasive pad machines, abrasive slurry type resilient abrasive pad machines and machines having platens with integral coatings of abrasive.

DETAILED DESCRIPTION OF THE INVENTION

Figure 1:
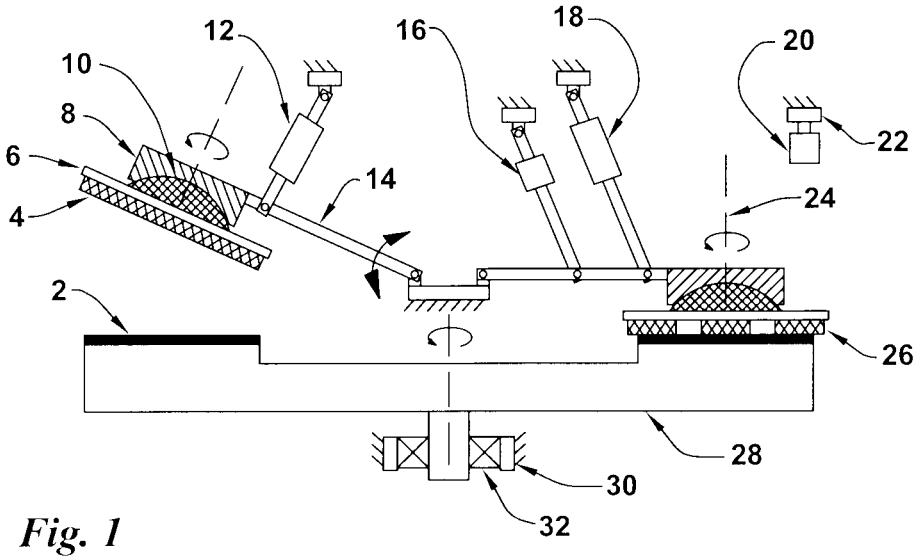
FIG. 1 is a cross section view of a dynamic action abrasive lapping workholder system.

FIG. 1 is a cross section view of a dynamic action abrasive lapping workholder system. A rotatable lower abrading platen 28 is supported by a rotatable bearing 32 that is attached to a single-sided abrading machine frame 30. The rotatable platen 28 has an abrasive coated disk 2 that is shown in abrading contact with small multiple workpieces 26 that are attached to a approximately horizontal workholder disk 6 that is attached to a spherical-action rotatable rotor 10 that is seated in a spherical rotor base 8 that is attached to a pivot arm 14. The large single workpiece 4 is attached to a workholder 6 that has a pivot arm 14 that is shown in a raised position where a force-device 12 that is attached to the machine frame 30 applies a lifting force to the pivot arm 14. A force-device 18 is also shown attached to a pivot arm 14 that is in a horizontal position where the small multiple workpieces 26 are shown in abrading contact with the abrasive coating on the abrasive disk 2. Also, a vibration, shock, motion, force or sound sensor 16 is attached to the pivot arm 14 to sense abrading process events that could make it desirable to activate lifting of the pivot arm 14 to lift the workpieces 26 and 4 away from the abrasive disk 2.

A signal can be sent from the sensor 16 to activate the force-devices 12 or 18 to lift the workpieces 26 and 4 away from abrading contact with the abrasive disk 2 that is attached to the moving flat-surfaced rotatable lower abrading platen 28. In addition a vibration, shock, motion, force or sound sensor 20 can be attached to the abrading machine frame bracket 22 that is attached to the abrading machine frame 30 and this sensor 20 can also be used to sense abrading process events that could make it desirable to activate lifting of the pivot arm 14 to lift the workpieces 26 and 4 away from the abrasive disk 2. After the pivot arm 14 lifts the workpieces 26 and 4 away from the abrasive disk 2 and action is taken to correct any problems such as a incorrectly-selected abrasive disk 2 or the occurrence of a torn or ripped abrasive disk 2 or a desire to quickly change abrading process procedures, the force-devices 12 or 18 can be deactivated to return the workpieces 26 and 4 to having abrading contact with the abrasive disk 2 by lowering the pivot arm 14 back to a horizontal position.

The force-device 12 can be a spring, an air cylinder, a screw-jack, an electric solenoid or a piezo-electric device. When a signal is sent from a sensor 16 or another sensor (not shown) or a controller device (not shown) to an abrading system controller (not shown), selected dynamic action abrasive lapping workholders 6 or all the dynamic action abrasive lapping workholders 6 used on the abrading system may be activated where the respective workpieces 26 and 4 are lifted to avoid abrading contact with the abrasive disk 2 or to avoid contact with the abrading platen 28. The workholder apparatus frame motion inducing force-devices 12 or 18 can have an adjustable acceleration force and where the workholder apparatus frame motion inducing force device can be selected from the group consisting of: a spring, an air cylinder or hydraulic cylinder, a motor driven screw-jack, an electric solenoid or a piezo-electric device.

Figure 2:
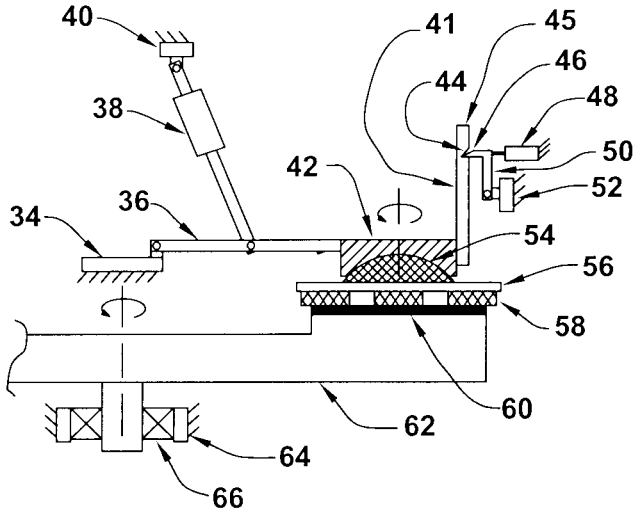
FIG. 2 is cross section view of a dynamic action abrasive lapping workholder latch device.

FIG. 2 is cross section view of a dynamic action abrasive lapping workholder latch device. A dynamic action abrasive lapping workholder system 50 is shown. Here, a rotatable lower abrading platen 62 is supported by a rotatable bearing 66 that is attached to a single-sided abrading machine frame 64. The rotatable platen 62 has an abrasive coated disk 60 that is shown in abrading contact with small multiple workpieces 58 that are attached to a approximately horizontal workholder disk 56 that is attached to a spherical-action rotatable rotor 54 that is seated in a spherical rotor base 42 that is attached to a pivot arm 36. A force-device 38 that is attached to the machine frame component 40 applies a lifting force to the pivot arm 36 that is pivotally-attached to the stationary base 34. The small multiple workpieces 58 are shown in abrading contact with the abrasive coating on the abrasive disk 60. A workpiece 58 positioning device 45 positions the small multiple workpieces 58 to be in abrading contact with the abrasive coating on the abrasive disk 60 by use of notch bar 41 that is attached to the spherical rotor base 42 that is attached to a pivot arm 36 where the notch bar 41 has a notch 44 that accepts an angled-end pivot bar 46 that is attached to the abrading machine base component 52 to provide an selected position of the workpieces 58 relative to the machine base component 52.

The fundamental design features of the workpiece 58 positioning device 45 can be configured to provide controlled position of the workpieces 58 relative to the abrasive surface of the abrasive coated disk 60. The angled-end pivot bar 46 can be moved quickly by an angled-end pivot bar 46 activation-devices 48 where the activation-devices 48 can be of a variety of designs that are activated by various power sources including pneumatic, electrical-solenoid or piezo-electric. After activation, the angled-end pivot bar 46 can be moved quickly by an angled-end pivot bar 46 activation-devices 48 and the force-devices 38 can lift the workpieces 58 away from abrading contact with the abrasive disk 60 that is attached to the moving flat-surfaced rotatable lower abrading platen 62. In addition a vibration, shock, motion, force or sound sensor (not shown) can be attached to the abrading machine frame 40 and this sensor can also be used to sense abrading process events that could make it desirable to activate lifting of the pivot arm 36 to lift the workpieces 58 away from the abrasive disk 60.

After the pivot arm 36 lifts the workpieces 58 away from the abrasive disk 60 and action is taken to correct any problems such as a incorrectly-selected abrasive disk 60 or the occurrence of a torn or ripped abrasive disk 60 or a desire to quickly change abrading process procedures, the force-devices 38 can be deactivated to return the workpieces 58 to having abrading contact with the abrasive disk 60 by lowering the pivot arm 36 back to a horizontal position where the where the notch bar 41 has a notch 44 that accepts an angled-end pivot bar 46 that is attached to the abrading machine base component 52 reestablishes the selected position of the workpieces 58 relative to the machine base component 52. When a signal is sent from a sensor (not shown) or a controller device (not shown) to an abrading system 50 controller (not shown), selected dynamic action abrasive lapping workholders 56 or all the dynamic action abrasive lapping workholders 56 used on the abrading system may be activated where the respective workpieces 58 are lifted to avoid abrading contact with the abrasive disk 60 or to avoid contact with the abrading platen 62.

The workholder apparatus frame motion inducing force-devices 38 can have an adjustable acceleration force and where the workholder apparatus frame motion inducing force device can be selected from the group consisting of: a spring, an air cylinder or hydraulic cylinder, a motor driven screw-jack, an electric solenoid or a piezo-electric device.

Figure 3:
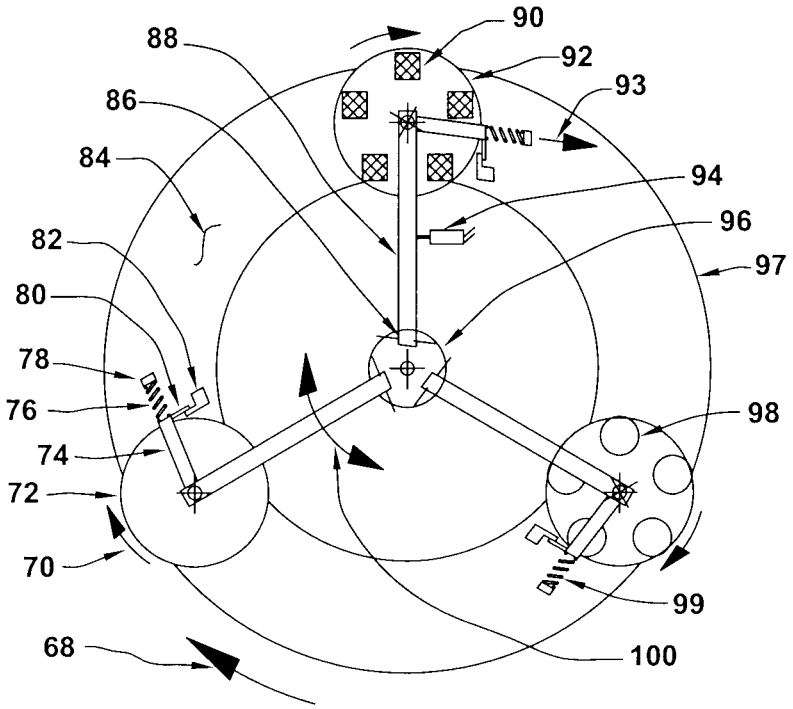
FIG. 3 is a top view of a friction-activated dynamic action abrasive lapping workholder.

FIG. 3 is a top view of a friction-activated dynamic action abrasive lapping workholder. A friction-activated dynamic action abrasive lapping workholder 99 has a pivot support arm 88 that is attached to a stationary base 96 and has a pivot joint 86 that allows the support arm 88 to pivot upward away from the rotatable platen 97 flat abrading surface 84. The pivot joint 86 also allows the support arm 88 to pivot slightly in a platen 97 circumferential direction 100 when friction between the workpieces 72, 90 and 98 that are in abrading contact with the moving rotatable platen 97 flat abrading surface 84 produces a friction force 93 that acts upon the compressed spring 76. When the abrading force 93 overcomes the compressed-spring 76 restraining force, the support pivot arm 88 rotates slightly in the circumferential direction 100 where the pivot arm 88 lock-bar 80 becomes detached from the stationary lock-device 82 and the pivot arm 88 is accelerated away from the moving rotatable platen 97 flat abrading surface 84 by a force-device (not shown) and the workpieces 72, 90 and 98 are moved away from abrading contact with the moving rotatable platen 97 flat abrading surface 84. The workholder apparatus frame motion inducing force-devices can have an adjustable acceleration force and where the workholder apparatus frame motion inducing force device can be selected from the group consisting of: a spring, an air cylinder or hydraulic cylinder, a motor driven screw-jack, an electric solenoid or a piezo-electric device.

Also, a force or position sensor 94 that contacts the pivot arm 88 can be used to sense when the friction force 93 is excessive at which time the sensor 94 is used to trigger the release of the pivot arm 88 by an activation-type locking device (not shown). The workpieces 72, 90 and 98 are attached to rotatable workholder disks 92 that typically rotate in the direction 70 or in a direction that is the reverse of direction 70 and the platen 97 rotates in the direction 68 to produce the friction force 93. The compressed spring 76 is supported by a spring stop 78 where the spring 76 acts against a pivot arm 88 bar 74 that is attached to the pivot arm 88.

Figure 4:
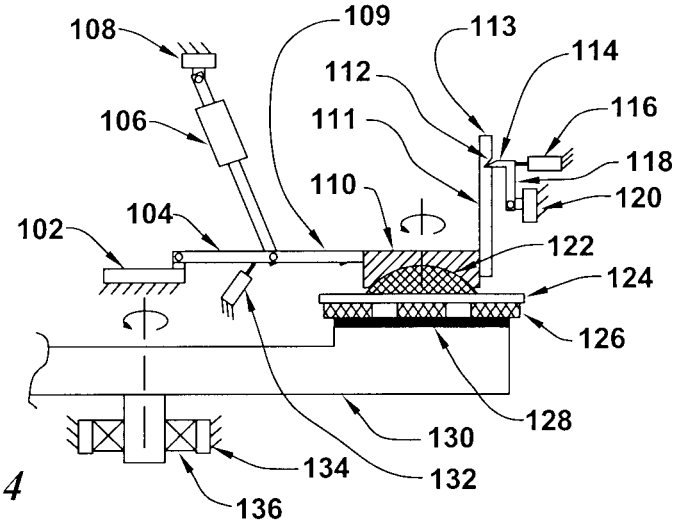
FIG. 4 is cross section view of a friction-activated dynamic action workholder system.

FIG. 4 is cross section view of a friction-activated or sensor-activated dynamic action workholder system. A dynamic action abrasive lapping workholder system 118 is shown. Here, a rotatable lower abrading platen 130 is supported by a rotatable bearing 136 that is attached to a single-sided abrading machine frame 134. The rotatable platen 130 has an abrasive coated disk 128 that is shown in abrading contact with small multiple workpieces 126 that are attached to a approximately horizontal workholder disk 124 that is attached to a spherical-action rotatable rotor 122 that is seated in a spherical rotor base 110 that is attached to a pivot arm 104. A force-device 106 that is attached to the machine frame component 108 applies a lifting force to the pivot arm 104 that is pivotally-attached to the stationary base 102. The small multiple workpieces 126 are shown in abrading contact with the abrasive coating on the abrasive disk 128. A workpiece 126 positioning device 113 positions the small multiple workpieces 126 to be in abrading contact with the abrasive coating on the abrasive disk 128 by use of notch bar 111 that is attached to the spherical rotor base 110 that is attached to a pivot arm 104 where the notch bar 111 has a notch 112 that accepts an angled-end pivot bar 114 that is attached to the abrading machine base component 120 to provide an selected position of the workpieces 126 relative to the machine base component 120. The workholder apparatus frame motion inducing force-devices 106 can have an adjustable acceleration force and where the workholder apparatus frame motion inducing force device can be selected from the group consisting of: a spring, an air cylinder or hydraulic cylinder, a motor driven screw-jack, an electric solenoid or a piezo-electric device.

In one embodiment, the friction-activated dynamic action abrasive lapping workholder 109 has a pivot support arm 104 where the workholder 109 allows the support arm 104 to pivot upward away from the rotatable platen 130 flat abrading surface 128. The pivot arm 104 also pivots slightly in the platen 130 circumferential direction when friction between the workpieces 126 that are in abrading contact with the moving rotatable platen 130 flat abrading surface 128 produces a friction force that acts upon a compressed spring (not shown). When the abrading force overcomes the compressed-spring restraining force, the support pivot arm 104 rotates slightly in the platen 130 circumferential direction where the pivot arm 104 lock-bar (not shown) becomes detached from a stationary lock-device (not shown) and the pivot arm 104 is accelerated away from the moving rotatable platen 130 flat abrading surface 128 and the workpieces 126 are moved away from abrading contact with the moving rotatable platen 130 flat abrading surface 128.

The fundamental design features of the workpiece 126 positioning device 113 can be configured to provide controlled position of the workpieces 126 relative to the abrasive surface of the abrasive coated disk 128. The angled-end pivot bar 114 can be moved quickly by an angled-end pivot bar 114 activation-devices 116 where the activation-devices 116 can be of a variety of designs that are activated by various power sources including pneumatic, electrical-solenoid or piezo-electric. After activation, the angled-end pivot bar 114 can be moved quickly by an angled-end pivot bar 114 activation-devices 116 and the force-devices 106 can lift the workpieces 126 away from abrading contact with the abrasive disk 128 that is attached to the moving flat-surfaced rotatable lower abrading platen 130. In addition a vibration, shock, motion, force or sound sensor (not shown) can be attached to the abrading machine frame 108 and this sensor can also be used to sense abrading process events that could make it desirable to activate lifting of the pivot arm 104 to lift the workpieces 126 away from the abrasive disk 128.

After the pivot arm 104 lifts the workpieces 126 away from the abrasive disk 128 and action is taken to correct any problems such as a incorrectly-selected abrasive disk 128 or the occurrence of a torn or ripped abrasive disk 128 or a desire to quickly change abrading process procedures, the force-devices 106 can be deactivated to return the workpieces 126 to having abrading contact with the abrasive disk 128 by lowering the pivot arm 104 back to a horizontal position where the where the notch bar 111 has a notch 112 that accepts an angled-end pivot bar 114 that is attached to the abrading machine base component 120 reestablishes the selected position of the workpieces 126 relative to the machine base component 120. Also, a vibration, shock, motion, force or sound sensor 132 can contact the pivot arm 104 and this sensor 132 can also be used to sense abrading process events that could make it desirable to activate lifting of the pivot arm 104 to lift the workpieces 126 away from the abrasive disk 128.

When a signal is sent from a sensor 132 or another sensor (not shown) or a controller device (not shown) to an abrading system controller (not shown), selected dynamic action abrasive lapping workholders 124 or all the dynamic action abrasive lapping workholders 124 used on the abrading system 118 may be activated where the respective workpieces 126 are lifted to avoid abrading contact with the abrasive disk 128 or to avoid contact with the abrading platen 130. If abrading friction activates the abrading system 118 the individual abrading system 118 may be activated or all of the individual abrading system 118 (not shown) on the abrading machine (not shown) may be activated where the workpieces 126 are lifted to avoid abrading contact with the abrasive disk 128 or to avoid contact with the abrading platen 130.

In another embodiment, the abrading friction activated dynamic action abrasive lapping workholder can be restrained by an angled latching device where the abrading friction can act against the angled latching device. Here, the restraining latching device is released by the abrading force where the a pivot support arm supporting a workholder allows the pivot support arm to pivot or move upward away from the rotatable platen flat abrading surface. The angled latching device can be reset by sliding the contacting workholder pivot arm mechanism along the angled latching device to reengage the locking action of the angled latching device to hold the workholder pivot support arm at a selected stationary position where abrading of the workpieces can be resumed.

Dynamic Action Abrasive Lapping Workholder Description

A dynamic action rotatable workholder apparatus is described that positions workpieces in flat-surfaced single-sided abrading contact with a rotatable abrading platen and that is activated by abrading friction contact forces to move the workpieces away from contact with the rotatable abrading platen comprising:

a) an abrading machine frame;

b) a workholder apparatus frame attached to the abrading machine frame by a mechanism that allows the workholder apparatus frame to be moved away from or toward the abrading machine frame;

c) a rotatable workholder plate having a flat-surfaced workpiece attachment surface and having a rotatable workholder plate rotation axis that is perpendicular to and is located at the center of the rotatable workholder plate flat-surfaced workpiece attachment surface where the rotatable workholder plate can be rotated about the rotatable workholder plate rotation axis and wherein the rotatable workholder plate is attached to the workholder apparatus frame;

d) a rotatable abrading platen having an approximately-horizontal flat annular abrading-surface and having a rotatable abrading platen rotation axis that is perpendicular to and is located at the center of the rotatable abrading platen approximately-horizontal flat annular abrading-surface where the rotatable abrading platen can be rotated about the rotatable abrading platen rotation axis and where the rotatable abrading platen is attached to the abrading machine frame;

e) wherein the rotatable abrading platen approximately horizontal flat annular abrading-surface has an abrasive coating provided by an abrasive device selected from the group consisting of flexible abrasive disks, flexible raised-island abrasive disks, flexible abrasive disks with resilient backing layers, flexible abrasive disks with resilient backing layers having a vacuum-seal polymer backing layer, flexible abrasive disks having attached solid abrasive pellets, flexible chemical mechanical planarization resilient disk pads with liquid abrasive slurries, flexible chemical mechanical planarization resilient disk pads having nap covers, flexible shallow-island chemical mechanical planarization abrasive disks, flexible shallow-island abrasive disks with resilient backing layers having a vacuum-seal polymer backing layer, flexible flat-surfaced metal or polymer disks, and liquid abrasive-slurry coatings;

f) workpieces having parallel opposed workpiece flat top surfaces and workpiece flat bottom surfaces can be attached to the rotatable workholder plate wherein the workpieces' flat top surfaces are attached to the rotatable workholder plate flat-surfaced workpiece attachment surface;

g) wherein the workholder apparatus frame can be positioned at a selected location on the abrading machine frame where workpieces attached to the rotatable workholder plate flat-surfaced workpiece attachment surface are in flat-surfaced abradable contact with the rotatable abrading platen annular abrading-surface abrasive coating;

h) an abrading friction force activated locking mechanism that is attached to the workholder apparatus frame wherein the abrading friction force activated locking mechanism can be engaged to hold the workholder apparatus frame at a selected location on the abrading machine frame or where the abrading friction force activated locking mechanism can be disengaged to allow the workholder apparatus frame to be moved away from a selected location on the abrading machine frame;

i) wherein a motion inducing force device is attached to the workholder apparatus frame where the motion inducing force device can apply an acceleration force to the workholder apparatus frame to move the workholder apparatus frame away from the selected location on the abrading machine frame wherein workpieces attached to the rotatable workholder plate are moved away from contact with the rotatable abrading platen;

j) where the engaged workholder apparatus abrading friction force activated locking mechanism can act against a motion inducing force device acceleration force to hold the workholder apparatus frame at a selected location on the abrading machine frame;

k) wherein controlled workpiece abrading forces can be applied to workpieces attached to the rotatable workholder plate when the workholder apparatus frame is positioned at a selected location on the abrading machine frame where the flat bottom surfaces of workpieces attached to the rotatable workholder plate are in flat-surfaced abradable contact with the rotatable abrading platen annular abrading-surface abrasive coating wherein the controlled workpiece abrading forces urge the flat bottom surfaces of the workpieces against the rotatable abrading platen annular abrading-surface abrasive coating;

l) wherein an abrading friction force activated locking mechanism activation device can be activated to disengage the abrading friction force activated locking mechanism by abrading friction contact forces that are imposed upon workpieces attached to the rotatable workholder plate by the rotating abrading platen abrasive coating that is in abrading contact with the attached workpieces and therein imposed upon the abrading friction force activated locking mechanism activation device that is coupled to the rotatable workholder plate;

m) wherein the abrading friction force activated locking mechanism activation device has an adjustable force set-point where the abrading friction force activated locking mechanism activation device can be activated by abrading friction contact forces applied to the abrading friction force activated locking mechanism activation device that exceed the abrading friction force activated locking mechanism activation device adjusted force set-point wherein the abrading friction force activated locking mechanism is disengaged;

n) wherein workpieces can be attached to the rotatable workholder plate wherein the workholder apparatus frame can be positioned at a selected location on the abrading machine frame wherein the abrading friction force activated locking mechanism can be engaged to hold the workholder apparatus frame at the selected location on the abrading machine frame and wherein a motion inducing force device is attached to the workholder apparatus frame where the motion inducing force device applies an acceleration force to the workholder apparatus frame wherein attached workpieces' flat bottom surfaces are in flat-surfaced abradable contact with the rotatable abrading platen annular abrading-surface abrasive coating wherein controlled workpiece abrading forces can be applied to the attached workpieces to urge the attached workpieces' flat bottom surfaces against the rotatable abrading platen annular abrading-surface abrasive coating wherein the workpieces attached to the rotatable workholder plate can be rotated about the rotatable workholder plate rotational axis and wherein the rotatable abrading platen can be rotated about the rotatable abrading platen rotation axis to single-side abrade the attached workpieces' bottom surfaces;

o) wherein abrading friction contact forces can be imposed upon the attached workpieces and therein imposed upon the abrading friction force activated locking mechanism by the rotating abrading platen abrasive coating in abrading contact with the attached workpieces;

p) wherein the abrading friction force activated locking mechanism can be activated when the abrading friction contact forces exceed the abrading friction force activated locking mechanism activation device adjustable set-point to disengage the abrading friction force activated locking mechanism wherein the workholder apparatus frame is moved by the motion inducing force device acceleration force away from the selected location on the abrading machine frame wherein the attached workpieces are moved away from contact with the rotatable abrading platen approximately horizontal annular abrading-surface.

This dynamic action rotatable workholder apparatus can also be used with multiple dynamic action rotatable workholder apparatus on an abrading platen and where the workholder apparatus frame motion inducing force device has an adjustable acceleration force and where the workholder apparatus frame motion inducing force device is selected from the group consisting of: a spring, an air or hydraulic cylinder, a motor driven screw-jack, an electric solenoid or a piezo-electric device.

A process is also described of using a dynamic action rotatable workholder apparatus that positions workpieces in flat-surfaced single-sided abrading contact with a rotatable abrading platen and that is activated by abrading friction contact forces to move the workpieces away from contact with the rotatable abrading platen comprising:

a) providing an abrading machine frame;

b) providing a workholder apparatus frame attached to the abrading machine frame by a mechanism that allows the workholder apparatus frame to be moved away from or toward the abrading machine frame;

c) providing a rotatable workholder plate having a flat-surfaced workpiece attachment surface and having a rotatable workholder plate rotation axis that is perpendicular to and is located at the center of the rotatable workholder plate flat-surfaced workpiece attachment surface where the rotatable workholder plate can be rotated about the rotatable workholder plate rotation axis and wherein the rotatable workholder plate is attached to the workholder apparatus frame;

d) providing a rotatable abrading platen having an approximately-horizontal flat annular abrading-surface and having a rotatable abrading platen rotation axis that is perpendicular to and is located at the center of the rotatable abrading platen approximately-horizontal flat annular abrading-surface where the rotatable abrading platen can be rotated about the rotatable abrading platen rotation axis and where the rotatable abrading platen is attached to the abrading machine frame;

e) providing that the rotatable abrading platen approximately horizontal flat annular abrading-surface has an abrasive coating provided by an abrasive device selected from the group consisting of flexible abrasive disks, flexible raised-island abrasive disks, flexible abrasive disks with resilient backing layers, flexible abrasive disks with resilient backing layers having a vacuum-seal polymer backing layer, flexible abrasive disks having attached solid abrasive pellets, flexible chemical mechanical planarization resilient disk pads with liquid abrasive slurries, flexible chemical mechanical planarization resilient disk pads having nap covers, flexible shallow-island chemical mechanical planarization abrasive disks, flexible shallow-island abrasive disks with resilient backing layers having a vacuum-seal polymer backing layer, flexible flat-surfaced metal or polymer disks, and liquid abrasive-slurry coatings;

f) attaching workpieces having parallel opposed workpiece flat top surfaces and workpiece flat bottom surfaces to the rotatable workholder plate wherein the workpieces' flat top surfaces are attached to the rotatable workholder plate flat-surfaced workpiece attachment surface;

g) positioning the workholder apparatus frame at a selected location on the abrading machine frame where workpieces attached to the rotatable workholder plate flat-surfaced workpiece attachment surface are in flat-surfaced abradable contact with the rotatable abrading platen annular abrading-surface abrasive coating;

h) attaching an abrading friction force activated locking mechanism to the workholder apparatus frame wherein the abrading friction force activated locking mechanism can be engaged to hold the workholder apparatus frame at the selected location on the abrading machine frame or where the abrading friction force activated locking mechanism can be disengaged to allow the workholder apparatus frame to be moved away from the selected location on the abrading machine frame;

i) activating the abrading friction force activated locking mechanism to engage the workholder apparatus frame wherein the workholder apparatus frame is held at the selected location on the abrading machine frame;

j) attaching a motion inducing force device to the workholder apparatus frame where the motion inducing force device applies an acceleration force to the workholder apparatus frame where the acceleration force can move the workholder apparatus frame away from the selected location on the abrading machine frame when the abrading friction force activated locking mechanism is disengaged wherein workpieces attached to the rotatable workholder plate are moved away from contact with the rotatable abrading platen;

k) providing that the engaged abrading friction force activated locking mechanism acts against the motion inducing force device acceleration force to hold the workholder apparatus frame at the selected location on the abrading machine frame;

l) applying controlled workpiece abrading forces to the workpieces attached to the rotatable workholder plate when the workholder apparatus frame is positioned at the selected location on the abrading machine frame where the flat bottom surfaces of the workpieces attached to the rotatable workholder plate are in flat-surfaced abradable contact with the rotatable abrading platen annular abrading-surface abrasive coating wherein the controlled workpiece abrading forces urge the flat bottom surfaces of the workpieces against the rotatable abrading platen annular abrading-surface abrasive coating;

m) providing an abrading friction force activated locking mechanism activation device that can be activated to disengage the abrading friction force activated locking mechanism by abrading friction contact forces that are imposed upon the workpieces attached to the rotatable workholder plate by the rotating abrading platen abrasive coating that is in abrading contact with the attached workpieces and therein imposed upon the abrading friction force activated locking mechanism activation device that is coupled to the rotatable workholder plate;

n) providing that the abrading friction force activated locking mechanism activation device has an adjustable force set-point where the abrading friction force activated locking mechanism activation device can be activated by abrading friction contact forces applied to the abrading friction force activated locking mechanism activation device that exceed the abrading friction force activated locking mechanism activation device adjusted force set-point wherein the abrading friction force activated locking mechanism is disengaged;

o) rotating the workpieces attached to the rotatable workholder plate about the rotatable workholder plate rotational axis and rotating the rotatable abrading platen about the rotatable abrading platen rotation axis to single-side abrade the attached workpieces' bottom surfaces;

p) wherein abrading friction contact forces are imposed upon the attached workpieces and therein imposed upon the abrading friction force activated locking mechanism activation device by the rotating abrading platen abrasive coating that is in abrading contact with the attached workpieces;

q) providing that the abrading friction force activated locking mechanism can be activated when the abrading friction contact forces exceed the abrading friction force activated locking mechanism activation device adjustable set-point to disengage the abrading friction force activated locking mechanism wherein the workholder apparatus frame is moved by the motion inducing force device acceleration force away from the selected location on the abrading machine frame wherein the attached workpieces are moved away from contact with the rotatable abrading platen approximately horizontal annular abrading-surface;

r) activating the abrading friction force activated locking mechanism activation device to disengage the abrading friction force activated locking mechanism by abrading friction contact forces that are imposed upon the workpieces attached to the rotatable workholder plate and therein imposed upon the abrading friction force activated locking mechanism activation device that is coupled to the rotatable workholder plate when the abrading friction contact forces exceed the abrading friction force activated locking mechanism activation device adjustable set-point wherein the abrading friction force activated locking mechanism is disengaged wherein the workholder apparatus frame is moved by the motion inducing force device acceleration force away from the selected location on the abrading machine frame wherein the attached workpieces are moved away from contact with the rotatable abrading platen approximately horizontal annular abrading-surface.

In addition, this process is also described where multiple dynamic action rotatable workholder apparatus are used on an abrading platen and where the workholder apparatus frame motion inducing force device has an adjustable acceleration force and where the workholder apparatus frame motion inducing force device is selected from the group consisting of: a spring, an air or hydraulic cylinder, a motor driven screw-jack, an electric solenoid or a piezo-electric device.

Further, this process is also described where the abrading friction force activated locking mechanism can be engaged or disengaged by an abrading friction force activated locking mechanism engagement device that is activated by event-sensor devices selected from the group consisting of a vibration, shock, motion, force, abrading friction force or sound sensors or wherein the abrading friction force activated locking mechanism can be engaged or disengaged by an abrading friction force activated locking mechanism engagement device that is activated by a process controller wherein the abrading friction force activated locking mechanism event-sensor devices are attached to either the workholder apparatus frame or to the abrading machine frame.

In another embodiment, this process is also described where an abrading friction force activated locking mechanism can be engaged or disengaged by an abrading friction force activated locking mechanism engagement device that is activated by event-sensor devices selected from the group consisting of a vibration, shock, motion, force, abrading friction force or sound sensors or wherein the abrading friction force activated locking mechanism can be engaged or disengaged by an abrading friction force activated locking mechanism engagement device that is activated by a process controller wherein the abrading friction force activated locking mechanism event-sensor devices are attached to either the workholder apparatus frame or to the abrading machine frame wherein selected dynamic action rotatable workholder apparatus workholder apparatus frames' abrading friction force activated locking mechanisms are activated to move the respective workholder apparatus frames away from the respective workholder apparatus selected locations on the abrading machine frame wherein the workpieces attached to the respective rotatable workholder plates are moved away from contact with the rotatable abrading platen or wherein the workpieces attached to the respective rotatable workholder plates are moved away from contact with the rotatable abrading platen annular abrading-surface abrasive coating.

Also described is a dynamic action rotatable workholder apparatus that positions workpieces in flat-surfaced single-sided abrading contact with a rotatable abrading platen and that is activated to move the workpieces away from contact with the rotatable abrading platen comprising:

a) an abrading machine frame;

b) a workholder apparatus frame attached to the abrading machine frame by a mechanism that allows the workholder apparatus frame to be moved away from or toward the abrading machine frame;

c) a rotatable workholder plate having a flat-surfaced workpiece attachment surface and having a rotatable workholder plate rotation axis that is perpendicular to and is located at the center of the rotatable workholder plate flat-surfaced workpiece attachment surface where the rotatable workholder plate can be rotated about the rotatable workholder plate rotation axis and wherein the rotatable workholder plate is attached to the workholder apparatus frame;

d) a rotatable abrading platen having an approximately-horizontal flat annular abrading-surface and having a rotatable abrading platen rotation axis that is perpendicular to and is located at the center of the rotatable abrading platen approximately-horizontal flat annular abrading-surface where the rotatable abrading platen can be rotated about the rotatable abrading platen rotation axis and where the rotatable abrading platen is attached to the abrading machine frame;

e) wherein the rotatable abrading platen approximately horizontal flat annular abrading-surface has an abrasive coating provided by an abrasive device selected from the group consisting of flexible abrasive disks, flexible raised-island abrasive disks, flexible abrasive disks with resilient backing layers, flexible abrasive disks with resilient backing layers having a vacuum-seal polymer backing layer, flexible abrasive disks having attached solid abrasive pellets, flexible chemical mechanical planarization resilient disk pads with liquid abrasive slurries, flexible chemical mechanical planarization resilient disk pads having nap covers, flexible shallow-island chemical mechanical planarization abrasive disks, flexible shallow-island abrasive disks with resilient backing layers having a vacuum-seal polymer backing layer, flexible flat-surfaced metal or polymer disks, and liquid abrasive-slurry coatings;

f) workpieces having parallel opposed workpiece flat top surfaces and workpiece flat bottom surfaces can be attached to the rotatable workholder plate wherein the workpieces' flat top surfaces are attached to the rotatable workholder plate flat-surfaced workpiece attachment surface;

g) wherein the workholder apparatus frame can be positioned at a selected location on the abrading machine frame where workpieces attached to the rotatable workholder plate flat-surfaced workpiece attachment surface are in flat-surfaced abradable contact with the rotatable abrading platen annular abrading-surface abrasive coating;

h) a workholder apparatus frame locking mechanism that is attached to the workholder apparatus frame wherein the workholder apparatus frame locking mechanism can be engaged to hold the workholder apparatus frame at the selected location on the abrading machine frame or where a workholder apparatus frame locking mechanism can be disengaged to allow the workholder apparatus frame to be moved away from a selected location on the abrading machine frame;

i) wherein a motion inducing force device is attached to the workholder apparatus frame where the motion inducing force device can apply an acceleration force to the workholder apparatus frame to move the workholder apparatus frame away from a selected location on the abrading machine frame wherein workpieces attached to the rotatable workholder plate are moved away from contact with the rotatable abrading platen;

j) wherein the engaged workholder apparatus frame locking mechanism can act against the motion inducing force device acceleration force to hold the workholder apparatus frame at a selected location on the abrading machine frame;

k) wherein controlled workpiece abrading forces can be applied to workpieces attached to the rotatable workholder plate when the workholder apparatus frame is positioned at a selected location on the abrading machine frame where the workpieces attached to the rotatable workholder plate flat bottom surfaces are in flat-surfaced abradable contact with the rotatable abrading platen annular abrading-surface abrasive coating wherein the controlled workpiece abrading forces urge the attached workpieces' flat bottom surfaces against the rotatable abrading platen annular abrading-surface abrasive coating;

l) wherein a workholder apparatus frame locking mechanism activation device can be activated to either engage or disengage the workholder apparatus frame locking mechanism;

m) wherein the workholder apparatus frame locking mechanism activation device is activated by an event-sensor device selected from the group consisting of a vibration, shock, motion, force, abrading friction force or sound sensors wherein the workholder apparatus frame locking mechanism activation device event-sensor devices are attached to the workholder apparatus frame;

n) wherein workpieces can be attached to the rotatable workholder plate wherein the workholder apparatus frame can be positioned at a selected location on the abrading machine frame wherein the workholder apparatus frame locking mechanism activation device is activated to engage the workholder apparatus frame locking mechanism and wherein a motion inducing force device is attached to the workholder apparatus frame where the motion inducing force device applies an acceleration force to the workholder apparatus frame wherein the attached workpieces' flat bottom surfaces are in flat-surfaced abradable contact with the rotatable abrading platen annular abrading-surface abrasive coating wherein controlled workpiece abrading forces are applied to the attached workpieces to urge the attached workpieces' flat bottom surfaces against the rotatable abrading platen annular abrading-surface abrasive coating wherein the workpieces attached to the rotatable workholder plate are rotated about the rotatable workholder plate rotational axis and wherein the rotatable abrading platen is rotated about the rotatable abrading platen rotation axis to single-side abrade the attached workpieces' bottom surfaces;

o) wherein the workholder apparatus frame locking mechanism activation device can be activated by a workholder apparatus frame locking mechanism activation event-sensor device to disengage the workholder apparatus frame locking mechanism wherein the workholder apparatus frame is accelerated by the motion inducing force device acceleration force away from the workholder apparatus selected location on the abrading machine frame wherein the workpieces attached to the rotatable workholder plate are moved away from contact with the rotatable abrading platen.

In addition, this dynamic action rotatable workholder apparatus that positions workpieces in flat-surfaced single-sided abrading contact with a rotatable abrading platen and that is activated to move the workpieces away from contact with the rotatable abrading platen can have multiple dynamic action rotatable workholder apparatus that are used on an abrading platen and where the workholder apparatus frame motion inducing force device has an adjustable acceleration force and where the workholder apparatus frame motion inducing force device is selected from the group consisting of: a spring, an air or hydraulic cylinder, a motor driven screw-jack, an electric solenoid or a piezo-electric device.

Further, this dynamic action rotatable workholder apparatus is described where the workholder apparatus frame locking mechanism activation device is activated by an event-sensor device selected from the group consisting of a vibration, shock, motion, force, abrading friction force or sound sensors wherein the workholder apparatus frame locking mechanism activation device event-sensor devices are attached to the abrading machine frame. Also, this dynamic action rotatable workholder apparatus is described where the workholder apparatus frame locking mechanism activation device can be activated by a process controller to interrupt workpiece abrading action or to move the workholder apparatus frame away from the workholder apparatus selected location on the abrading machine frame wherein the workpieces attached to the rotatable workholder plate are moved away from contact with the rotatable abrading platen or wherein the workpieces attached to the rotatable workholder plate are moved away from contact with the rotatable abrading platen annular abrading-surface abrasive coating.

Another embodiment of this dynamic action rotatable workholder apparatus is described where a dynamic action rotatable workholder apparatus workholder apparatus frame locking mechanism activation device can be activated wherein selected dynamic action rotatable workholder apparatus workholder apparatus frames' locking mechanism activation devices are activated to move the respective workholder apparatus frames away from the respective workholder apparatus selected locations on the abrading machine frame wherein the workpieces attached to the respective rotatable workholder plates are moved away from contact with the rotatable abrading platen or wherein the workpieces attached to the respective rotatable workholder plates are moved away from contact with the rotatable abrading platen annular abrading-surface abrasive coating.

A process is described of using a dynamic action rotatable workholder apparatus that positions workpieces in flat-surfaced single-sided abrading contact with a rotatable abrading platen and that is activated to move the workpieces away from contact with the rotatable abrading platen comprising:

a) providing an abrading machine frame;

b) providing a workholder apparatus frame attached to the abrading machine frame by a mechanism that allows the workholder apparatus frame to be moved away from or toward the abrading machine frame;

c) providing a rotatable workholder plate having a flat-surfaced workpiece attachment surface and having a rotatable workholder plate rotation axis that is perpendicular to and is located at the center of the rotatable workholder plate flat-surfaced workpiece attachment surface where the rotatable workholder plate can be rotated about the rotatable workholder plate rotation axis and wherein the rotatable workholder plate is attached to the workholder apparatus frame;

d) providing a rotatable abrading platen having an approximately-horizontal flat annular abrading-surface and having a rotatable abrading platen rotation axis that is perpendicular to and is located at the center of the rotatable abrading platen approximately-horizontal flat annular abrading-surface where the rotatable abrading platen can be rotated about the rotatable abrading platen rotation axis and where the rotatable abrading platen is attached to the abrading machine frame;

e) providing that the rotatable abrading platen approximately horizontal flat annular abrading-surface has an abrasive coating provided by an abrasive device selected from the group consisting of flexible abrasive disks, flexible raised-island abrasive disks, flexible abrasive disks with resilient backing layers, flexible abrasive disks with resilient backing layers having a vacuum-seal polymer backing layer, flexible abrasive disks having attached solid abrasive pellets, flexible chemical mechanical planarization resilient disk pads with liquid abrasive slurries, flexible chemical mechanical planarization resilient disk pads having nap covers, flexible shallow-island chemical mechanical planarization abrasive disks, flexible shallow-island abrasive disks with resilient backing layers having a vacuum-seal polymer backing layer, flexible flat-surfaced metal or polymer disks, and liquid abrasive-slurry coatings;

f) attaching workpieces having parallel opposed workpiece flat top surfaces and workpiece flat bottom surfaces to the rotatable workholder plate wherein the workpieces' flat top surfaces are attached to the rotatable workholder plate flat-surfaced workpiece attachment surface;

g) positioning the workholder apparatus frame at a selected location on the abrading machine frame where workpieces attached to the rotatable workholder plate flat-surfaced workpiece attachment surface are in flat-surfaced abradable contact with the rotatable abrading platen annular abrading-surface abrasive coating;

h) providing a workholder apparatus frame locking mechanism that is attached to the workholder apparatus frame wherein the workholder apparatus frame locking mechanism can be engaged to hold the workholder apparatus frame at a selected location on the abrading machine frame or where the workholder apparatus frame locking mechanism can be disengaged to allow the workholder apparatus frame to be moved away from a selected location on the abrading machine frame;

i) providing a workholder apparatus frame locking mechanism activation device that can be activated to either engage or disengage the workholder apparatus frame locking mechanism;

j) providing that the workholder apparatus frame locking mechanism activation device can be activated by an event-sensor device selected from the group consisting of a vibration, shock, motion, force, abrading friction force or sound sensors wherein the workholder apparatus frame locking mechanism activation device event-sensor devices are attached to the workholder apparatus frame wherein an engaged workholder apparatus frame locking mechanism is disengaged to allow the workholder apparatus frame to be moved away from a selected location on the abrading machine frame;

k) activating the workholder apparatus frame locking device mechanism activation device to engage the workholder apparatus frame locking device mechanism wherein the workholder apparatus frame is held at a selected location on the abrading machine frame;

l) attaching a motion inducing force device to the workholder apparatus frame where the motion inducing force device applies an acceleration force to the workholder apparatus frame where the acceleration force can move the workholder apparatus frame away from the selected location on the abrading machine frame wherein workpieces attached to the rotatable workholder plate are moved away from contact with the rotatable abrading plate when the workholder apparatus frame locking device mechanism activation device is disengaged;

m) applying controlled workpiece abrading forces to the workpieces attached to the rotatable workholder plate when the workholder apparatus frame is positioned at a selected location on the abrading machine frame where the workpieces attached to the rotatable workholder plate flat-surfaced workpiece attachment surface are in flat-surfaced abradable contact with the rotatable abrading platen annular abrading-surface abrasive coating wherein the controlled workpiece abrading forces urge the attached workpieces' flat bottom surfaces against the rotatable abrading platen annular abrading-surface abrasive coating;

n) rotating the workpieces attached to the rotatable workholder plate about the rotatable workholder plate rotational axis and rotating the rotatable abrading platen about the rotatable abrading platen rotation axis to single-side abrade the attached workpieces' bottom surfaces;

o) wherein the workholder apparatus frame locking mechanism activation device is activated by a workholder apparatus frame locking mechanism activation event-sensor device to disengage the workholder apparatus frame locking mechanism wherein the workholder apparatus frame is accelerated by the motion inducing force device acceleration force away from the workholder apparatus frame selected location on the abrading machine frame wherein the attached workpieces are moved away from contact with the rotatable abrading platen approximately horizontal annular abrading-surface.

This process of using a dynamic action rotatable workholder apparatus that positions workpieces in flat-surfaced single-sided abrading contact with a rotatable abrading platen is also described where multiple dynamic action rotatable workholder apparatus are used on an abrading platen and where the workholder apparatus frame motion inducing force device has an adjustable acceleration force and where the workholder apparatus frame motion inducing force device is selected from the group consisting of: a spring, an air or hydraulic cylinder, a motor driven screw-jack, an electric solenoid or a piezo-electric device.

Further, this process of using a dynamic action rotatable workholder apparatus that positions workpieces in flat-surfaced single-sided abrading contact with a rotatable abrading platen is also described where the workholder apparatus frame locking mechanism activation device is activated by event-sensor devices selected from the group consisting of vibration, shock, motion, force, abrading friction force or sound event-sensor devices wherein the workholder apparatus frame locking mechanism activation device event-sensor devices are attached to the abrading machine frame. Also, this process is described where the workholder apparatus frame locking mechanism activation device can be activated by a process controller to interrupt workpiece abrading action or to move the workholder apparatus frame away from the workholder apparatus selected location on the abrading machine frame wherein the workpieces attached to the rotatable workholder plate are moved away from contact with the rotatable abrading platen or wherein the workpieces attached to the rotatable workholder plate are moved away from contact with the rotatable abrading platen annular abrading-surface abrasive coating.

In another embodiment, this process of using a dynamic action rotatable workholder apparatus that positions workpieces in flat-surfaced single-sided abrading contact with a rotatable abrading platen is also described where a dynamic action rotatable workholder apparatus workholder apparatus frame locking mechanism activation device can be activated wherein selected dynamic action rotatable workholder apparatus workholder apparatus frames' locking mechanism activation devices are activated to move the respective workholder apparatus frames away from the respective workholder apparatus selected locations on the abrading machine frame wherein the workpieces attached to the respective rotatable workholder plates are moved away from contact with the rotatable abrading platen or wherein the workpieces attached to the respective rotatable workholder plates are moved away from contact with the rotatable abrading platen annular abrading-surface abrasive coating.

What is claimed:

1. A dynamic action rotatable workholder apparatus that positions workpieces in flat-surfaced single-sided abrading contact with a rotatable abrading platen that is activated by abrading friction contact forces to move the workpieces away from contact with the rotatable abrading platen comprising:

a) an abrading machine frame;

b) a workholder apparatus frame attached to the abrading machine frame by a mechanism that allows the workholder apparatus frame to be moved away from or toward the abrading machine frame;

c) a rotatable workholder plate having a flat-surfaced workpiece attachment surface and having a rotatable workholder plate rotation axis that is perpendicular to and is located at a center of the rotatable workholder plate flat-surfaced workpiece attachment surface where the rotatable workholder plate can be rotated about the rotatable workholder plate rotation axis and wherein the rotatable workholder plate is moveably attached to the workholder apparatus frame;

d) a rotatable abrading platen having an approximately horizontal flat annular abrading-surface and having a rotatable abrading platen rotation axis that is perpendicular to and is located at a center of the rotatable abrading platen approximately-horizontal flat annular abrading-surface where the rotatable abrading platen can be rotated about the rotatable abrading platen rotation axis and where the rotatable abrading platen is moveably attached to the abrading machine frame;

e) wherein the rotatable abrading platen approximately horizontal flat annular abrading-surface has an abrasive layer provided by an abrasive device selected from the group consisting of flexible abrasive disks, flexible raised-island abrasive disks, flexible abrasive disks with resilient backing layers, flexible abrasive disks with resilient backing layers having a vacuum-seal polymer backing layer, flexible abrasive disks having attached solid abrasive pellets, flexible chemical mechanical planarization resilient disk pads with liquid abrasive slurries, flexible chemical mechanical planarization resilient disk pads having nap covers, flexible shallow-island chemical mechanical planarization abrasive disks, flexible shallow-island abrasive disks with resilient backing layers having a vacuum-seal polymer backing layer, flexible flat-surfaced metal or polymer disks, and liquid abrasive-slurry layers;

f) workpieces having parallel opposed workpiece flat top surfaces and workpiece flat bottom surfaces, wherein the workpieces' flat top surfaces are attached to the rotatable workholder plate flat-surfaced workpiece attachment surface;

g) wherein the workholder apparatus frame can be positioned at a location on the abrading machine frame where workpieces attached to the rotatable workholder plate flat-surfaced workpiece attachment surface are in flat-surfaced abradable contact with the rotatable abrading platen annular abrading-surface abrasive coating;

h) an abrading friction force-activated locking mechanism that is attached to the workholder apparatus frame wherein the abrading friction force activated locking mechanism can be engaged to hold the workholder apparatus frame at a location on the abrading machine frame or where the abrading friction force activated locking mechanism can be disengaged to allow the workholder apparatus frame to be moved away from a location on the abrading machine frame;

i) wherein a motion-inducing force device is attached to the workholder apparatus frame where the motion inducing force device can apply an acceleration force to the workholder apparatus frame to move the workholder apparatus frame away from the location on the abrading machine frame wherein workpieces attached to the rotatable workholder plate are moved away from contact with the rotatable abrading platen;

j) where the engaged workholder apparatus abrading friction force activated locking mechanism can act against a motion inducing force device acceleration force to hold the workholder apparatus frame at a location on the abrading machine frame;

k) wherein controlled workpiece abrading forces can be applied to workpieces attached to the rotatable workholder plate when the workholder apparatus frame is positioned at a location on the abrading machine frame where the flat bottom surfaces of workpieces attached to the rotatable workholder plate are in flat-surfaced abradable contact with the rotatable abrading platen annular abrading-surface abrasive layer wherein the controlled workpiece abrading forces urge the flat bottom surfaces of the workpieces against the rotatable abrading platen annular abrading-surface abrasive layer;

l) wherein an abrading friction force activated locking mechanism activation device can be activated to disengage the abrading friction force activated locking mechanism by abrading friction contact forces that are imposed upon workpieces attached to the rotatable workholder plate by the rotating abrading platen abrasive layer that is in abrading contact with the attached workpieces and therein imposed upon the abrading friction force activated locking mechanism activation device that is coupled to the rotatable workholder plate;

m) wherein the abrading friction force activated locking mechanism activation device has an adjustable force set-point where the abrading friction force activated locking mechanism activation device can be activated by abrading friction contact forces applied to the abrading friction force activated locking mechanism activation device that exceed the abrading friction force activated locking mechanism activation device adjusted force set-point wherein the abrading friction force activated locking mechanism is disengaged;

n) wherein workpieces can be attached to the rotatable workholder plate wherein the workholder apparatus frame can be positioned at a location on the abrading machine frame wherein the abrading friction force activated locking mechanism can be engaged to hold the workholder apparatus frame at the location on the abrading machine frame and wherein a motion inducing force device is attached to the workholder apparatus frame where the motion inducing force device applies an acceleration force to the workholder apparatus frame wherein attached workpieces' flat bottom surfaces are in flat-surfaced abradable contact with the rotatable abrading platen annular abrading-surface abrasive layer wherein controlled workpiece abrading forces can be applied to the attached workpieces to urge the attached workpieces' flat bottom surfaces against the rotatable abrading platen annular abrading-surface abrasive layer wherein the workpieces attached to the rotatable workholder plate can be rotated about the rotatable workholder plate rotational axis and wherein the rotatable abrading platen can be rotated about the rotatable abrading platen rotation axis to single-side abrade the attached workpieces' bottom surfaces;

o) wherein abrading friction contact forces can be imposed upon the attached workpieces and therein imposed upon the abrading friction force activated locking mechanism by the rotating abrading platen abrasive layer in abrading contact with the attached workpieces;

p) wherein the abrading friction force activated locking mechanism can be activated when the abrading friction contact forces exceed the abrading friction force activated locking mechanism activation device adjustable set-point to disengage the abrading friction force activated locking mechanism wherein the workholder apparatus frame is moved by the motion inducing force device acceleration force away from the location on the abrading machine frame wherein the attached workpieces are moved away from contact with the rotatable abrading platen approximately horizontal annular abrading-surface.

2. The apparatus of claim 1 where multiple dynamic action rotatable workholder apparatus are used on an abrading platen.

3. The apparatus of claim 1 where the workholder apparatus frame motion inducing force device has an adjustable acceleration force and where the workholder apparatus frame motion inducing force device is selected from the group consisting of: a spring, an air cylinder; hydraulic cylinder, a motor driven screw-jack, an electric solenoid; and a piezoelectric device.

4. A process of using a dynamic action rotatable workholder apparatus that positions workpieces in flat-surfaced single-sided abrading contact with a rotatable abrading platen and that is activated by abrading friction contact forces to move the workpieces away from contact with the rotatable abrading platen comprising:

a) providing an abrading machine frame;

b) moving a workholder apparatus frame attached to the abrading machine frame by a mechanism to move the workholder apparatus away from or toward the abrading machine frame;

c) providing a rotatable workholder plate having a flat-surfaced workpiece attachment surface and having a rotatable workholder plate rotation axis that is perpendicular to and is located at the center of the rotatable workholder plate flat-surfaced workpiece attachment surface and rotating the rotatable workholder plate about the rotatable workholder plate rotation axis and wherein the rotatable workholder plate is attached to the workholder apparatus frame;

d) providing a rotatable abrading platen having an approximately-horizontal flat annular abrading-surface and having a rotatable abrading platen rotation axis that is perpendicular to and is located at a center of the rotatable abrading platen approximately-horizontal flat annular abrading-surface and rotating the rotatable abrading platen about the rotatable abrading platen rotation axis and where the rotatable abrading platen is attached to the abrading machine frame;

e) providing that the rotatable abrading platen approximately horizontal flat annular abrading-surface has an abrasive layer provided by an abrasive device selected from the group consisting of flexible abrasive disks, flexible raised-island abrasive disks, flexible abrasive disks with resilient backing layers, flexible abrasive disks with resilient backing layers having a vacuum-seal polymer backing layer, flexible abrasive disks having attached solid abrasive pellets, flexible chemical mechanical planarization resilient disk pads with liquid abrasive slurries, flexible chemical mechanical planarization resilient disk pads having nap covers, flexible shallow-island chemical mechanical planarization abrasive disks, flexible shallow-island abrasive disks with resilient backing layers having a vacuum-seal polymer backing layer, flexible flat-surfaced metal or polymer disks, and liquid abrasive-slurry layers;

f) attaching workpieces having parallel opposed workpiece flat top surfaces and workpiece flat bottom surfaces to the rotatable workholder plate wherein the workpieces' flat top surfaces are attached to the rotatable workholder plate flat-surfaced workpiece attachment surface;

g) positioning the workholder apparatus frame at a first location on the abrading machine frame where workpieces attached to the rotatable workholder plate flat-surfaced workpiece attachment surface are in flat-surfaced abradable contact with the rotatable abrading platen annular abrading-surface abrasive layer;

h) attaching an abrading friction force activated locking mechanism to the workholder apparatus frame wherein the abrading friction force activated locking mechanism can be engaged to hold the workholder apparatus frame at the first location on the abrading machine frame or where the abrading friction force activated locking mechanism is disengaged to allow the workholder apparatus frame to move away from the first elected location on the abrading machine frame;

i) activating the abrading friction force activated locking mechanism to engage the workholder apparatus frame wherein the workholder apparatus frame is held at the first location on the abrading machine frame;

j) attaching a motion inducing force device to the workholder apparatus frame where the motion inducing force device applies an acceleration force to the workholder apparatus frame where the acceleration force moves the workholder apparatus frame away from the first location on the abrading machine frame when the abrading friction force activated locking mechanism is disengaged wherein workpieces attached to the rotatable workholder plate are moved away from contact with the rotatable abrading platen;

k) providing that the engaged abrading friction force activated locking mechanism acts against the motion inducing force device acceleration force to hold the workholder apparatus frame at the first location on the abrading machine frame;

l) applying controlled workpiece abrading forces to the workpieces attached to the rotatable workholder plate when the workholder apparatus frame is positioned at the first location on the abrading machine frame where the flat bottom surfaces of the workpieces attached to the rotatable workholder plate are in flat-surfaced abradable contact with the rotatable abrading platen annular abrading-surface abrasive layer wherein the controlled workpiece abrading forces urge the flat bottom surfaces of the workpieces against the rotatable abrading platen annular abrading-surface abrasive layer;

m) activating an abrading friction force activated locking mechanism activation device to disengage the abrading friction force activated locking mechanism by abrading friction contact forces that are imposed upon the workpieces attached to the rotatable workholder plate by the rotating abrading platen abrasive layer that is in abrading contact with the attached workpieces and therein imposed upon the abrading friction force activated locking mechanism activation device that is coupled to the rotatable workholder plate;

n) providing the abrading friction force activated locking mechanism activation device with an adjustable force set-point where the abrading friction force activated locking mechanism activation device is activated by abrading friction contact forces applied to the abrading friction force activated locking mechanism activation device that exceed the abrading friction force activated locking mechanism activation device adjusted force set-point wherein the abrading friction force activated locking mechanism is disengaged;

o) rotating the workpieces attached to the rotatable workholder plate about the rotatable workholder plate rotational axis and rotating the rotatable abrading platen about the rotatable abrading platen rotation axis to single-side abrade the attached workpieces' bottom surfaces;

p) imposing abrading friction contact forces upon the attached workpieces and therein imposed upon the abrading friction force activated locking mechanism activation device by the rotating abrading platen abrasive layer that is in abrading contact with the attached workpieces;

q) activating the abrading friction force activated locking mechanism when the abrading friction contact forces exceed the abrading friction force activated locking mechanism activation device adjustable set-point to disengage the abrading friction force activated locking mechanism wherein the workholder apparatus frame is moved by the motion inducing force device acceleration force away from the selected location on the abrading machine frame wherein the attached workpieces are moved away from contact with the rotatable abrading platen approximately horizontal annular abrading-surface;

r) activating the abrading friction force activated locking mechanism activation device to disengage the abrading friction force activated locking mechanism by abrading friction contact forces that are imposed upon the workpieces attached to the rotatable workholder plate and therein imposed upon the abrading friction force activated locking mechanism activation device that is coupled to the rotatable workholder plate when the abrading friction contact forces exceed the abrading friction force activated locking mechanism activation device adjustable set-point wherein the abrading friction force activated locking mechanism is disengaged and the workholder apparatus frame is moved by the motion inducing force device acceleration force away from the first location on the abrading machine frame wherein the attached workpieces are moved away from contact with the rotatable abrading platen approximately horizontal annular abrading-surface.

5. The process of claim 4 where multiple dynamic action rotatable workholder apparatus are simultaneously used on an abrading platen.

6. The process of claim 4 where the workholder apparatus frame motion inducing force device has an adjustable acceleration force and where the workholder apparatus frame motion inducing force device is selected from the group consisting of: a spring, an air cylinder; hydraulic cylinder, a motor driven screw-jack, an electric solenoid; and a piezoelectric device.

7. The process of claim 4 where the abrading friction force activated locking mechanism is engaged or disengaged by an abrading friction force activated locking mechanism engagement device activated by event-sensor devices selected from the group consisting of a vibration sensor, shock sensor, motion sensor, force sensor, abrading friction force sensor and sound sensors, or the abrading friction force activated locking mechanism is engaged or disengaged by an abrading friction force activated locking mechanism engagement device activated by a processor wherein the abrading friction force activated locking mechanism event-sensor devices are attached to either the workholder apparatus frame or to the abrading machine frame.

8. The process of claim 5 where an abrading friction force activated locking mechanism is engaged or disengaged by an abrading friction force activated locking mechanism engagement device activated by event-sensor devices selected from the group consisting of a vibration sensor, shock sensor, motion sensor, force sensor, abrading friction force sensor and sound sensor or wherein the abrading friction force activated locking mechanism is engaged or disengaged by an abrading friction force activated locking mechanism engagement device activated by a processor wherein the abrading friction force activated locking mechanism event-sensor devices are attached to either the workholder apparatus frame or to the abrading machine frame wherein selected dynamic action rotatable workholder apparatus workholder apparatus frames' abrading friction force activated locking mechanisms are activated to move the respective workholder apparatus frames away from the respective workholder apparatus first locations on the abrading machine frame wherein the workpieces attached to the respective rotatable workholder plates are moved away from contact with the rotatable abrading platen or wherein the workpieces attached to the respective rotatable workholder plates are moved away from contact with the rotatable abrading platen annular abrading-surface abrasive layer.

9. A dynamic action rotatable workholder apparatus that positions workpieces in flat-surfaced single-sided abrading contact with a rotatable abrading platen and that is activated to move the workpieces away from contact with the rotatable abrading platen comprising:

a) an abrading machine frame;

b) a workholder apparatus frame attached to the abrading machine frame by a mechanism that allows the workholder apparatus frame to be moved away from or toward the abrading machine frame;

c) a rotatable workholder plate having a flat-surfaced workpiece attachment surface and having a rotatable workholder plate rotation axis that is perpendicular to and is located at a center of the rotatable workholder plate flat-surfaced workpiece attachment surface where the rotatable workholder plate can be rotated about the rotatable workholder plate rotation axis and wherein the rotatable workholder plate is attached to the workholder apparatus frame;

d) a rotatable abrading platen having an approximately-horizontal flat annular abrading-surface and having a rotatable abrading platen rotation axis that is perpendicular to and is located at a center of the rotatable abrading platen approximately-horizontal flat annular abrading-surface where the rotatable abrading platen can be rotated about the rotatable abrading platen rotation axis and where the rotatable abrading platen is attached to the abrading machine frame;

e) wherein the rotatable abrading platen approximately horizontal flat annular abrading-surface has an abrasive layer;

f) workpieces having parallel opposed workpiece flat top surfaces and workpiece flat bottom surfaces are attached to the rotatable workholder plate wherein the workpieces' flat top surfaces are attached to the rotatable workholder plate flat-surfaced workpiece attachment surface;

g) wherein the workholder apparatus frame can be positioned at a first location on the abrading machine frame where workpieces attached to the rotatable workholder plate flat-surfaced workpiece attachment surface are in flat-surfaced abradable contact with the rotatable abrading platen annular abrading-surface abrasive layer;

h) a workholder apparatus frame locking mechanism attached to the workholder apparatus frame wherein the workholder apparatus frame locking mechanism can be engaged to hold the workholder apparatus frame at the first location on the abrading machine frame or where a workholder apparatus frame locking mechanism can be disengaged to allow the workholder apparatus frame to be moved away from a selected location on the abrading machine frame;

i) wherein a motion inducing force device is attached to the workholder apparatus frame where the motion inducing force device can apply an acceleration force to the workholder apparatus frame to move the workholder apparatus frame away from the first location on the abrading machine frame wherein workpieces attached to the rotatable workholder plate are moved away from contact with the rotatable abrading platen;

j) wherein the engaged workholder apparatus frame locking mechanism can act against the motion inducing force device acceleration force to hold the workholder apparatus frame at the first location on the abrading machine frame;

k) wherein controlled workpiece abrading forces can be applied to workpieces attached to the rotatable workholder plate when the workholder apparatus frame is positioned at the first location on the abrading machine frame where the workpieces attached to the rotatable workholder plate flat bottom surfaces are in flat-surfaced abradable contact with the rotatable abrading platen annular abrading-surface abrasive coating wherein the controlled workpiece abrading forces urge the attached workpieces' flat bottom surfaces against the rotatable abrading platen annular abrading-surface abrasive layer;

l) wherein a workholder apparatus frame locking mechanism activation device can be activated to either engage or disengage the workholder apparatus frame locking mechanism;

m) wherein the workholder apparatus frame locking mechanism activation device is activated by an event-sensor device selected from the group consisting of a vibration sensor, shock sensor, motion sensor, force sensor, abrading friction force sensor and sound sensors wherein the workholder apparatus frame locking mechanism activation device event-sensor devices are attached to the workholder apparatus frame;

n) wherein workpieces can be attached to the rotatable workholder plate wherein the workholder apparatus frame can be positioned at a second location on the abrading machine frame wherein the workholder apparatus frame locking mechanism activation device is activated to engage the workholder apparatus frame locking mechanism and wherein a motion inducing force device is attached to the workholder apparatus frame where the motion inducing force device applies an acceleration force to the workholder apparatus frame wherein the attached workpieces' flat bottom surfaces are in flat-surfaced abradable contact with the rotatable abrading platen annular abrading-surface abrasive layer wherein controlled workpiece abrading forces are applied to the attached workpieces to urge the attached workpieces' flat bottom surfaces against the rotatable abrading platen annular abrading-surface abrasive layer wherein the workpieces attached to the rotatable workholder plate are rotated about the rotatable workholder plate rotational axis and wherein the rotatable abrading platen is rotated about the rotatable abrading platen rotation axis to single-side abrade the attached workpieces' bottom surfaces;

o) wherein the workholder apparatus frame locking mechanism activation device can be activated by a workholder apparatus frame locking mechanism activation event-sensor device to disengage the workholder apparatus frame locking mechanism wherein the workholder apparatus frame is accelerated by the motion inducing force device acceleration force away from the workholder apparatus second location on the abrading machine frame wherein the workpieces attached to the rotatable workholder plate are moved away from contact with the rotatable abrading platen.

10. The apparatus of claim 9 where multiple dynamic action rotatable workholder apparatus are simultaneously present on an abrading platen.

11. The apparatus of claim 9 where the workholder apparatus frame motion inducing force device has an adjustable acceleration force and where the workholder apparatus frame motion inducing force device is selected from the group consisting of: a spring, an air cylinder, hydraulic cylinder, a motor driven screw-jack, an electric solenoid and a piezo-electric device.

12. The apparatus of claim 9 where the workholder apparatus frame locking mechanism activation device is activated by an event-sensor device selected from the group consisting of a vibration sensor, shock sensor, motion sensor, force sensor, abrading friction force sensor and sound sensor wherein the workholder apparatus frame locking mechanism activation device event-sensor devices are attached to the abrading machine frame.

13. The apparatus of claim 9 where the workholder apparatus frame locking mechanism activation device can be activated by a processor to interrupt workpiece abrading action or to move the workholder apparatus frame away from the workholder apparatus second location on the abrading machine frame wherein the workpieces attached to the rotatable workholder plate are moved away from contact with the rotatable abrading platen or wherein the workpieces attached to the rotatable workholder plate are moved away from contact with the rotatable abrading platen annular abrading-surface abrasive layer.

14. The apparatus of claim 10 where a dynamic action rotatable workholder apparatus workholder apparatus frame locking mechanism activation device can be activated wherein selected dynamic action rotatable workholder apparatus workholder apparatus frames' locking mechanism activation devices are activated to move the respective workholder apparatus frames away from the respective workholder apparatus second locations on the abrading machine frame wherein the workpieces attached to the respective rotatable workholder plates are moved away from contact with the rotatable abrading platen or wherein the workpieces attached to the respective rotatable workholder plates are moved away from contact with the rotatable abrading platen annular abrading-surface abrasive layer.

15. A process of using a dynamic action rotatable workholder apparatus that positions workpieces in flat-surfaced single-sided abrading contact with a rotatable abrading platen and that is activated to move the workpieces away from contact with the rotatable abrading platen comprising:

a) providing an abrading machine frame;

b) providing a workholder apparatus frame attached to the abrading machine frame by a mechanism that allows the workholder apparatus frame to be moved away from or toward the abrading machine frame;

c) providing a rotatable workholder plate having a flat-surfaced workpiece attachment surface and having a rotatable workholder plate rotation axis that is perpendicular to and is located at a center of the rotatable workholder plate flat-surfaced workpiece attachment surface where the rotatable workholder plate is rotated about the rotatable workholder plate rotation axis and wherein the rotatable workholder plate is attached to the workholder apparatus frame;

d) providing a rotatable abrading platen having an approximately-horizontal flat annular abrading-surface and having a rotatable abrading platen rotation axis that is perpendicular to and is located at a center of the rotatable abrading platen approximately-horizontal flat annular abrading-surface where the rotatable abrading platen is rotated about the rotatable abrading platen rotation axis and where the rotatable abrading platen is attached to the abrading machine frame;

e) providing the rotatable abrading platen approximately horizontal flat annular abrading-surface with an abrasive layer selected from the group consisting of flexible abrasive disks, flexible raised-island abrasive disks, flexible abrasive disks with resilient backing layers, flexible abrasive disks with resilient backing layers having a vacuum-seal polymer backing layer, flexible abrasive disks having attached solid abrasive pellets, flexible chemical mechanical planarization resilient disk pads with liquid abrasive slurries, flexible chemical mechanical planarization resilient disk pads having nap covers, flexible shallow-island chemical mechanical planarization abrasive disks, flexible shallow-island abrasive disks with resilient backing layers having a vacuum-seal polymer backing layer, flexible flat-surfaced metal or polymer disks, and liquid abrasive-slurry layers;

f) attaching workpieces having parallel opposed workpiece flat top surfaces and workpiece flat bottom surfaces to the rotatable workholder plate wherein the workpieces' flat top surfaces are attached to the rotatable workholder plate flat-surfaced workpiece attachment surface;

g) positioning the workholder apparatus frame at a selected location on the abrading machine frame where workpieces attached to the rotatable workholder plate flat-surfaced workpiece attachment surface are in flat-surfaced abradable contact with the rotatable abrading platen annular abrading-surface abrasive layer;

h) providing a workholder apparatus frame locking mechanism that is attached to the workholder apparatus frame and engaging the workholder apparatus frame locking mechanism to hold the workholder apparatus frame at a first location on the abrading machine frame or where the workholder apparatus frame locking mechanism is disengaged to allow the workholder apparatus frame to be moved away from the first location on the abrading machine frame;

i) activating a workholder apparatus frame locking mechanism activation device to either engage or disengage the workholder apparatus frame locking mechanism;

j) activating that the workholder apparatus frame locking mechanism activation device by an event-sensor device selected from the group consisting of a vibration sensor, shock sensor, motion sensor, force sensor, abrading friction force sensor and sound sensor wherein the workholder apparatus frame locking mechanism activation device event-sensor devices are attached to the workholder apparatus frame;

k) disengaging an engaged workholder apparatus frame locking mechanism to allow the workholder apparatus frame to be moved away from the first location on the abrading machine frame;

l) activating the workholder apparatus frame locking device mechanism activation device to engage the workholder apparatus frame locking device mechanism wherein the workholder apparatus frame is held at a second location on the abrading machine frame;

l) applying an acceleration force to the workholder apparatus with a motion inducing force device wherein the motion inducing force device applies an acceleration force to the workholder apparatus frame to move the workholder apparatus frame away from the second location on the abrading machine frame wherein workpieces attached to the rotatable workholder plate are moved away from contact with the rotatable abrading plate when the workholder apparatus frame locking device mechanism activation device is disengaged;

m) applying controlled workpiece abrading forces to the workpieces attached to the rotatable workholder plate when the workholder apparatus frame is positioned at a third location on the abrading machine frame where the workpieces attached to the rotatable workholder plate flat-surfaced workpiece attachment surface are in flat-surfaced abradable contact with the rotatable abrading platen annular abrading-surface abrasive layer wherein the controlled workpiece abrading forces urge the attached workpieces' flat bottom surfaces against the rotatable abrading platen annular abrading-surface abrasive layer;

n) rotating the workpieces attached to the rotatable workholder plate about the rotatable workholder plate rotational axis and rotating the rotatable abrading platen about the rotatable abrading platen rotation axis to single-side abrade the attached workpieces' bottom surfaces;

o) wherein the workholder apparatus frame locking mechanism activation device is activated by a workholder apparatus frame locking mechanism activation event-sensor device to disengage the workholder apparatus frame locking mechanism wherein the workholder apparatus frame is accelerated by the motion inducing force device acceleration force away from the workholder apparatus frame third location on the abrading machine frame wherein the attached workpieces are moved away from contact with the rotatable abrading platen approximately horizontal annular abrading-surface.

16. The process of claim 15 where multiple dynamic action rotatable workholder apparatus are simultaneously abraded on an abrading platen.

17. The process of claim 15 where the workholder apparatus frame motion inducing force device has an adjustable acceleration force and where the workholder apparatus frame motion inducing force device is selected from the group consisting of: a spring, an air cylinder, hydraulic cylinder, a motor driven screw-jack, an electric solenoid and a piezo-electric device.

18. The process of claim 15 where the workholder apparatus frame locking mechanism activation device is activated by event-sensor devices selected from the group consisting of vibration sensors, shock sensors, motion sensors, force sensors, abrading friction force sensors and sound event-sensor devices wherein the workholder apparatus frame locking mechanism activation device event-sensor devices are attached to the abrading machine frame.

19. The process of claim 15 where the workholder apparatus frame locking mechanism activation device is activated by a processor to interrupt workpiece abrading action or to move the workholder apparatus frame away from the workholder apparatus third location on the abrading machine frame wherein the workpieces attached to the rotatable workholder plate are moved away from contact with the rotatable abrading platen or wherein the workpieces attached to the rotatable workholder plate are moved away from contact with the rotatable abrading platen annular abrading-surface abrasive layer.

20. The process of claim 16 where a dynamic action rotatable workholder apparatus workholder apparatus frame locking mechanism activation device is activated and wherein selected dynamic action rotatable workholder apparatus workholder apparatus frames' locking mechanism activation devices are activated to move the respective workholder apparatus frames away from the respective workholder apparatus locations on the abrading machine frame wherein the workpieces attached to the respective rotatable workholder plates are moved away from contact with the rotatable abrading platen or wherein the workpieces attached to the respective rotatable workholder plates are moved away from contact with the rotatable abrading platen annular abrading-surface abrasive layer.

* * * * *